US012427386B2

(12) United States Patent
Lombardini

(10) Patent No.: US 12,427,386 B2
(45) Date of Patent: Sep. 30, 2025

(54) MULTIPLE GAME DEVICE

(71) Applicant: LIT LOMBARDINI INTEGRATED TECHNOLOGIES, Franklin, TN (US)

(72) Inventor: Martin Gabriel Lombardini, Franklin, TN (US)

(73) Assignee: LIT LOMBARDINI INTEGRATED TECHNOLOGIES, Franklin, TN (US)

( * ) Notice: Subject to any disclaimer, the term of this patent is extended or adjusted under 35 U.S.C. 154(b) by 0 days.

(21) Appl. No.: 17/182,958

(22) Filed: Feb. 23, 2021

(65) Prior Publication Data

US 2021/0260456 A1 Aug. 26, 2021

Related U.S. Application Data

(60) Provisional application No. 63/050,737, filed on Jul. 10, 2020, provisional application No. 63/048,189,
(Continued)

(51) Int. Cl.
*A63B 63/08* (2006.01)
*A63B 67/00* (2006.01)
(Continued)

(52) U.S. Cl.
CPC ..... *A63B 63/083* (2013.01); *A63B 67/06* (2013.01); *A63B 71/023* (2013.01); *A63B 67/007* (2013.01);
(Continued)

(58) Field of Classification Search
CPC ..... A63B 63/083; A63B 67/06; A63B 71/023; A63B 63/007; A63B 2071/026;
(Continued)

(56) References Cited

U.S. PATENT DOCUMENTS 2,130,820 A * 9/1938 Trumbull ..... A63B 63/08 273/350
2,938,729 A * 5/1960 Billfaldt ..... A63B 57/405 273/127 R
(Continued)

FOREIGN PATENT DOCUMENTS

AT 14259 U1 * 5/2015 ..... A63B 63/00
EP 2678083 A1 1/2014
(Continued)

OTHER PUBLICATIONS

KR200280503Y1 (Year: 2002).*
(Continued)

*Primary Examiner* — Eugene L Kim
*Assistant Examiner* — Amir A Klayman
(74) *Attorney, Agent, or Firm* — QuickPatents; Kevin Prince

(57) ABSTRACT

An apparatus includes a base, a receptacle, one or more vertical members, and a backboard. The base includes a first end, a second end positioned opposite of the first end, a first surface, and a second surface positioned opposite of the first surface. The receptacle is formed in the first surface of the base and positioned between the first end of the base and the second end of the base. The one or more vertical members extend from the base on a side of the receptacle positioned opposite of the first end of the base. The backboard is coupled to the one or more vertical members and includes a face oriented toward the receptacle. The face of the backboard extends in a plane which extends relative to the first surface of the base at an angle greater than ninety degrees.

12 Claims, 9 Drawing Sheets

Related U.S. Application Data filed on Jul. 5, 2020, provisional application No. 62/980,360, filed on Feb. 23, 2020.

(51) Int. Cl.
*A63B 67/06* (2006.01)
*A63B 71/02* (2006.01)

(52) U.S. Cl.
CPC ..... *A63B 2071/026* (2013.01); *A63B 2209/10* (2013.01); *A63B 2210/50* (2013.01); *A63B 2225/093* (2013.01); *A63B 2225/62* (2013.01)

(58) Field of Classification Search
CPC ..... A63B 2209/10; A63B 2210/50; A63B 2225/093; A63B 2225/62
See application file for complete search history.

(56) References Cited

U.S. PATENT DOCUMENTS 2,939,707 A * 6/1960 Lemelson ..... A63B 63/08 473/485
3,156,471 A * 11/1964 Bibeau ..... A63B 63/00 52/2.21
3,190,657 A * 6/1965 Johnson ..... A63B 57/40 273/458
3,469,844 A 9/1969 Sindelar
3,656,749 A 4/1972 Reyes
3,892,412 A * 7/1975 Koo ..... A63B 69/3661 473/160
4,189,148 A * 2/1980 Kato ..... F41J 9/06 273/350
4,412,680 A * 11/1983 Zorn ..... A63F 9/02 273/350
4,726,591 A * 2/1988 Johnson ..... A63B 67/06 273/338
4,986,549 A * 1/1991 Kuhtic ..... A63B 67/06 473/594
5,255,910 A * 10/1993 Simonseth ..... A63B 63/083 473/481
5,320,360 A * 6/1994 St. Pierre ..... A63F 9/0204 273/402
D353,641 S * 12/1994 Liu ..... D21/702
5,546,707 A * 8/1996 Caruso ..... E04C 3/29 52/2.21
D404,447 S * 1/1999 Wiedner ..... D21/781
D410,714 S * 6/1999 Sherwood ..... D21/701
5,967,513 A * 10/1999 Wells ..... A63F 9/02 273/330
6,030,300 A * 2/2000 Zheng ..... A63B 9/00 273/350
D433,471 S * 11/2000 Hsu ..... D21/701
6,196,938 B1 * 3/2001 Wiedner ..... A63B 63/083 473/481
6,338,686 B1 * 1/2002 King ..... A63B 71/0669 473/415
6,413,166 B1 * 7/2002 Long ..... A63B 67/02 473/160
D489,426 S * 5/2004 Oakley ..... D21/803
6,749,474 B2 * 6/2004 Hsu ..... A47C 15/006 441/131
7,048,654 B2 * 5/2006 Zheng ..... A63B 9/00 135/125
RE39,402 E * 11/2006 Chauvet ..... A63B 67/002 473/472
D540,895 S * 4/2007 Chiu ..... D21/702
7,360,767 B2 * 4/2008 Merccica ..... A63F 9/02 273/350
8,764,017 B2 * 7/2014 Manner ..... A63F 9/001 273/400
D736,321 S * 8/2015 Shadle ..... D21/302
D737,599 S * 9/2015 Aldridge ..... D6/604
9,192,841 B1 * 11/2015 Montgomery ..... A63B 69/3623
9,421,443 B2 * 8/2016 Boyer ..... A63B 63/00
9,592,430 B1 * 3/2017 Pollard ..... A63B 63/08
10,065,095 B2 * 9/2018 Gallagher ..... A63F 9/305
10,245,491 B2 * 4/2019 Scherba ..... A63B 17/00
11,331,550 B1 * 5/2022 Showalter ..... A63B 71/0669
11,554,303 B2 * 1/2023 Osthus ..... A63B 67/06
2004/0235388 A1 * 11/2004 Padilla ..... G09B 1/00 446/269
2005/0049090 A1 * 3/2005 Chen ..... A63B 63/083 473/479
2005/0261090 A1 * 11/2005 Ciullini ..... A63B 63/083 473/481
2006/0073748 A1 * 4/2006 Boujon ..... E04H 4/103 441/40
2006/0247072 A1 11/2006 Combs et al.
2008/0009374 A1 * 1/2008 Valdez ..... A63C 19/08 473/490
2009/0081919 A1 * 3/2009 Zheng ..... A63B 9/00 446/153
2009/0115136 A1 * 5/2009 Voden ..... A63B 21/0054 273/245
2010/0319122 A1 * 12/2010 Crumrine ..... A47D 13/061 5/99.1
2011/0124427 A1 * 5/2011 Green ..... A63B 69/3661 473/409
2011/0136597 A1 * 6/2011 Gordon ..... A63B 5/11 473/478
2012/0225742 A1 * 9/2012 Max ..... A63B 63/08 473/481
2013/0310235 A1 * 11/2013 Carr ..... A63B 21/022 482/145
2014/0054858 A1 2/2014 Boyer et al.
2014/0171232 A1 * 6/2014 Carney ..... A63B 63/004 473/477
2015/0115531 A1 * 4/2015 Ali ..... A63F 9/02 273/398
2016/0023095 A1 * 1/2016 Nally ..... A63F 7/3055 273/343
2016/0129333 A1 * 5/2016 Kroeten ..... A63B 63/004 473/478
2016/0166068 A1 * 6/2016 Holzhauzer ..... A63B 67/06 297/16.1
2017/0136328 A1 * 5/2017 Field ..... A63B 67/02
2017/0354855 A1 * 12/2017 Cullen ..... A63B 63/08
2018/0001171 A1 * 1/2018 Zavracky ..... A63B 67/007
2018/0028888 A1 * 2/2018 Silva ..... A63B 63/083
2018/0236370 A1 * 8/2018 Nadler ..... A63B 17/04
2019/0134476 A1 * 5/2019 Spady ..... A63B 67/002
2019/0184253 A1 * 6/2019 Silva ..... A63B 63/008
2021/0060399 A1 * 3/2021 Dingel ..... A63B 67/06
2021/0113901 A1 * 4/2021 McGetrick ..... A63B 63/083
2021/0121757 A1 * 4/2021 Cooper ..... A63B 67/06
2021/0322841 A1 * 10/2021 Lodge ..... A63B 67/007
2021/0331053 A1 * 10/2021 Zerby ..... A63B 67/06
2022/0072400 A1 * 3/2022 Deutsch ..... A63B 67/06
2022/0126182 A1 * 4/2022 Wu ..... A63B 63/083
2023/0173360 A1 * 6/2023 Curtis ..... A63B 63/08 473/479

FOREIGN PATENT DOCUMENTS

GB 2172509 A * 9/1986 ..... A63B 63/004
JP 2006340738 A * 12/2006
KR 200176753 Y1 * 5/2000 ..... A63B 67/007
KR 200280503 Y1 * 7/2002
KR 200374517 Y1 * 1/2005 ..... A63B 63/083
WO WO-2005030348 A1 * 4/2005 ..... A63B 71/023

OTHER PUBLICATIONS

JP-2006340738-A (Year: 2006).*
AT14259U1 (Year: 2015).*
KR 200374517 Y1 (Year: 2005).*

* cited by examiner

MULTIPLE GAME DEVICE

CROSS-REFERENCE TO RELATED APPLICATIONS

This application claims the benefit of United States Provisional Patent Application Nos. 62/980,360, filed on Feb. 23, 2020, titled "BASKETBALL AND CORN-HOLE GAME", 63/048,189, filed Jul. 5, 2020, titled "BUOYANT MULTIPLE GAME DEVICE", and 63/050,737, filed Jul. 10, 2020, titled "MULTIPLE GAME DEVICE", each of which is incorporated herein by reference in its entirety.

FIELD

The present application generally relates to game devices, and more particularly but not exclusively, to devices configured for use for multiple different games.

BACKGROUND

Unless otherwise indicated herein, the materials described herein are not prior art to the claims in the present application and are not admitted to be prior art by inclusion in this section.

Basketball and cornhole are two games that are both relatively popular games to play, and are both commonly found in personal settings, such as at a home or a neighborhood community space. In some circumstances, one or both of basketball and cornhole may be played on land, in the water, or both.

The subject matter claimed in the present disclosure is not limited to embodiments that solve any disadvantages or that operate only in environments such as those described above. Rather, this background is only provided to illustrate one example technology area where some embodiments described in the present disclosure may be practiced.

SUMMARY

In one embodiment, an apparatus includes a base, a receptacle, one or more vertical members, and a backboard. The base includes a first end, a second end positioned opposite of the first end, a first surface, and a second surface positioned opposite of the first surface. The receptacle is formed in the first surface of the base and positioned between the first end of the base and the second end of the base. The one or more vertical members extend from the base on a side of the receptacle positioned opposite of the first end of the base. The backboard is coupled to the one or more vertical members and includes a face oriented toward the receptacle. The face of the backboard extends in a plane which extends relative to the first surface of the base at an angle greater than ninety degrees.

In another embodiment, an apparatus includes a base, a receptacle, and one or more support members. The base includes a first end, a second end positioned opposite of the first end, a first surface, and a second surface positioned opposite of the first surface. The first end includes a first thickness between the first surface and the second surface, and the second end includes a second thickness between the first surface and the second surface. The second thickness is greater than the first thickness. The receptacle is formed in the first surface of the base and is positioned between the first end of the base and the second end of the base. The one or more support members extend from the base. At least one of the base and the one or more support members is inflatable.

In another embodiment, an apparatus includes a base, a receptacle, one or more vertical members, a backboard, and one or more legs. The base includes a first end, a second end positioned opposite of the first end, a first surface, and a second surface positioned opposite of the first surface. The receptacle extends through the base between the first surface of the base and the second surface of the base. The one or more vertical members extend from the base. The backboard is coupled to the base. The backboard is also spaced over the base by the one or more vertical members. The one or more legs are coupled to the base. The one or more legs are configured to elevate the second end of the base relative to the first end of the base to provide the first surface of the base at an inclination when the base is positioned on an underlying surface.

These and other aspects, features and advantages may become more fully apparent from the following brief description of the drawings, the drawings, the detailed description of preferred embodiments and appended claims.

BRIEF DESCRIPTION OF THE DRAWINGS

Example embodiments will be described and explained with additional specificity and detail through the use of the accompanying drawings in which.

DESCRIPTION OF EMBODIMENTS

Figure 1:
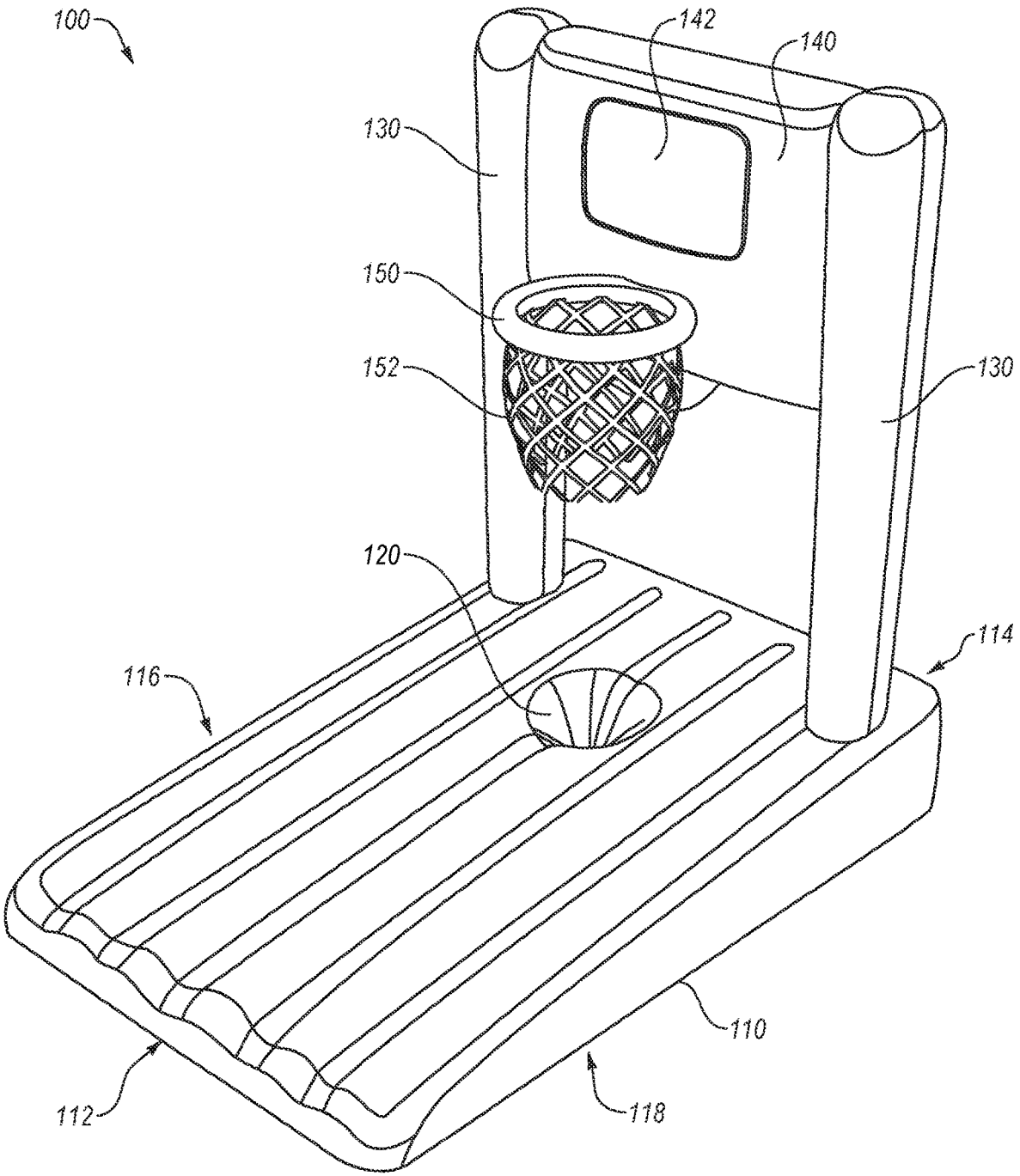
FIG. 1 is a perspective view of a device configured for use for multiple different games.

People enjoy playing various games with friends and family, often in personal settings, such as a home yard or pool and/or community areas including parks or pools. Some games include equipment that is used in playing the game. For example, cornhole includes an inclined board as a playing and/or scoring surface, and basketball includes a stanchion with a backboard and hoop. Games that are played in the water often include inflatable and/or buoyant equipment which may keep the game equipment above the water and in view of the players.

People that enjoy a variety of games, including games that include various equipment, may be limited in storage space.

In circumstances where people play many games, storing the equipment for the different games may consume a large amount of space. In circumstances where games are played in the water, such as a pool, space may be limited such that including equipment for more than one game may not be possible due to a limited playing area. Equipment used with games may also be difficult to transport due to the number of pieces of equipment and/or the relative size of the equipment and the difficulty in carrying it.

In some embodiments of the present disclosure, a device (also referred to herein as a multiple game device) may include equipment configured for use for multiple different games, such as cornhole and basketball. The multiple game device may be collapsible and/or inflatable such that it may be small and easy to store and/or easy to transport. In some embodiments, the multiple game device may be configured for use in or around water, such as a pool, and the combination of the games may reduce the amount of space taken in what may be a limited playing area.

In some circumstances, example embodiments of a multiple game device may contribute to lower costs to acquire both a basketball game and a cornhole game by combining basketball and cornhole equipment into a single product. Alternatively or additionally, the multiple game device may reduce costs by providing the option of basketball and cornhole equipment as a single product that may be used in both a water environment and a land environment.

In some circumstances, example embodiments of a multiple game device may result in equipment that is easier to store and transport than one or either of basketball equipment and/or cornhole equipment. Basketball and cornhole combined equipment may be easier to store and transport than both basketball equipment and cornhole equipment. Alternatively or additionally, in embodiments where the multiple game device includes inflatable equipment, the multiple game device may collapse to a small size that may be simple to transport and may be small and easy to store.

These and other embodiments of the present disclosure will be explained with reference to the accompanying figures. It is to be understood that the figures are diagrammatic and schematic representations of such example embodiments, and are not limiting, nor are they necessarily drawn to scale. In the figures, features with like numbers indicate like structure and function unless described otherwise.

FIG. 1 is a perspective view of an example multiple game device 100 configured for use for multiple different games, in accordance with at least one embodiment described in the present disclosure. The multiple game device 100 may include a base 110, a receptacle 120, vertical supports 130, and a backboard 140. The base 110 may include a first end 112, a second end 114, a first or upper surface 116, and a second or lower surface 118. The backboard 140 may include a rectangular insert 142 and a rim 150. The rim 150 may include a net 152.

In some embodiments, the base 110 may be substantially rectangular in shape. Alternatively or additionally, the base 110 may include other shapes. For example, the base 110 may include other shapes such a square, a triangle, a trapezoid, an oval, a circle, and/or other similar geometric shapes. In some embodiments, the base 110 may include a first end 112 and a second end 114 where the first end 112 may be positioned opposite the second end 114 on the base 110.

In some embodiments, the upper surface 116 may extend from the first end 112 to the second end 114. In some embodiments, the upper surface 116 may extend between opposite sides of the base 110 extending between the first end 112 and the second end 114, such that the upper surface 116 may be substantially planar and may be used as a playing surface. For example, in instances in which the base 110 is rectangular, the upper surface 116 may be a rectangularly shaped plane. In some embodiments, the upper surface 116 may be inclined from the first end 112 to the second end 114. In some embodiments, the upper surface 116 may be positioned opposite the lower surface 118.

In some embodiments, the lower surface 118 may extend from the first end 112 to the second end 114 and may extend between opposite sides of the base 110 extending between the first end 112 and the second end 114. In some embodiments, the lower surface 118 may be configured to contact a surface on which the multiple game device 100 is positioned. For example, the lower surface 118 may be in contact with a land surface, including grass, dirt, sand, and/or similar land environments in a land setting and/or may be in contact with a water surface, including water in a pool, a lake, an ocean, and/or similar water environments, in a water setting. In some embodiments, the lower surface 118 may be substantially flat, such that when the multiple game device 100 is disposed on a flat surface, the vertical supports 130 of the multiple game device 100 may be substantially perpendicular to the lower surface 118.

In some embodiments, the distance between the upper surface 116 and the lower surface 118 on the first end 112 may be less than the distance between the upper surface 116 and the lower surface 118 on the second end 114.

In some embodiments, the base 110 may be inflatable. Alternatively or additionally, the base 110 may include one or more buoyant materials configured to provide flotation of the device 100 in water. For example, the base 110 may include materials configured to retain air and/or provide buoyancy to the multiple game device 100. In some embodiments, the materials of the base 110 may include polyvinyl chloride (PVC), molded plastic, rubberized synthetic fabrics, blow-molded plastic, fiberglass, foam, fiberglass coated foam, glass, and/or other suitable materials for providing buoyancy. In some embodiments, the base 110 may include one or more materials in the composition thereof. For example, the upper surface 116 may include a high-density foam board which may absorb energy from an object impacting the base 110 via the upper surface 116. In some embodiments, the materials of the base 110 may include a sheath which may be stitched to other elements of the base 110 and may include novelty designs and/or logos.

In instances in which the base 110 includes inflatable materials, a valve may be disposed on the base 110 which may be used to facilitate inflation of the base 110. In one aspect, a valve may be disposed on the base 110 that may enable use of hand and/or electric pumps for inflation of the base 110.

In some embodiments, the receptacle 120 may be formed in the upper surface 116 of the base 110 and may be positioned between the first end 112 and the second end 114. In some embodiments, a center point of the receptacle 120 may be positioned on a centerline running from a midline of the first end 112 and a midline of the second end 114 and positioned nearer the second end 114 along the centerline.

In some embodiments, the receptacle 120 may extend through the base 110 from the upper surface 116 to the lower surface 118. For example, the shape of the receptacle 120 in the upper surface 116 may include a corresponding shape in the lower surface 118, and the receptacle 120 may include a channel between the upper surface 116 and the lower surface 118. Forms in which the shapes of the receptacle 120 at the upper surface 116 and the lower surface 120 are different are also possible. Alternatively or additionally, the receptacle 120 may include a closed end that may be positioned between the upper surface 116 and the lower surface 118. For example, a partition 113 may be positioned between the upper surface 116 and the lower surface 118 such that an object may not pass through the receptacle 120 from the upper surface 116 to the lower surface 118. The partition 113 may be a solid surface and/or a mesh surface, which may allow liquids to pass through but restrict objects from passage. Alternatively or additionally, the closed end of the receptacle 120 may include the lower surface 118. For example, the lower surface 118 may include a continuous surface, such that a channel between the upper surface 116 and the lower surface 118, in conjunction with the receptacle 120, is not present.

In some embodiments, the receptacle 120 may be circular in shape. Alternatively or additionally, the receptacle 120 may include different shapes. For example, the receptacle 120 may include shapes such as square, oval, triangular, pentagonal, hexagonal, and other similar shapes. In some embodiments, the shape of the receptacle 120 on the upper surface 116 may be similar to the shape of the receptacle 120 on the lower surface 118. Alternatively or additionally, the receptacle 120 may include different shapes on the upper surface 116 and the lower surface 118. In some embodiments, the channel of the receptacle 120 between the upper surface 116 and the lower surface 118 may include the same geometric shape as the shape on the upper surface 116 and the lower surface 118 of the receptacle 120.

In some embodiments, the vertical supports 130 may be coupled to the base 110. Alternatively or additionally, the vertical supports 130 may be formed from the same material as the base 110. In some embodiments, the vertical supports 130 may be positioned adjacent to the receptacle 120 and may be opposite the first end 112. Alternatively or additionally, the vertical supports 130 may be positioned at the second end 114. Alternatively or additionally, the vertical supports 130 may be positioned between the receptacle 120 and the second end 114.

In some embodiments, the vertical supports 130 may extend from the base 110 from the upper surface 116. Alternatively or additionally, the vertical supports 130 may extend from a lateral portion of the base 110, adjacent to the upper surface 116 and the lower surface 118.

In some embodiments, the vertical supports 130 may be substantially columnar from a coupling location on the base 110 to a distal end of the vertical supports 130. Alternatively or additionally, the vertical supports 130 may widen at or near the coupling location to the base 110, which may add stability to the vertical supports 130. For example, the vertical supports 130 may be columnar on the distal end and may gradually or quickly widen near the coupling location to the base 110.

In some embodiments, the vertical supports 130 may be inflatable. Alternatively or additionally, the vertical supports 130 may include buoyant materials that may float in water. For example, the vertical supports 130 may include materials configured to retain air and/or provide buoyancy to the multiple game device 100, which materials may be analogous to the materials of the base 110. Alternatively or additionally, the materials of the vertical supports 130 may include a sheath which may be stitched to other elements of the vertical supports 130 and may include novelty designs and/or logos.

In some embodiments, the vertical supports 130 may be coupled to the base 110 such that there is a fluid communication of air between the vertical supports 130 and the base 110. For example, a cavity on the inside of the vertical supports 130 may be joined with a cavity inside the base 110 such that the movement of air between the vertical supports 130 and the base 110 may be unrestricted.

Alternatively or additionally, the vertical supports 130 may include a partition that may restrict air passing between the cavity of the vertical supports 130 and the cavity of the base 110. In instances in which air does not pass between the vertical supports 130 and the base 110, a valve may be disposed in one or more supports of the vertical supports 130 which may be used for inflation of the vertical supports 130. In one aspect, a valve may be disposed in one or more supports of the vertical supports 130 and configured for enabling a hand and/or electric pump to be used for inflation of the vertical supports 130.

In some embodiments, the backboard 140 may be coupled to the vertical supports 130 and may be configured to be substantially perpendicular to the lower surface 118. In some embodiments, the backboard 140 may include a face that may be oriented toward the receptacle 130. In some embodiments, the face of the backboard 140 may extend in a plane that is substantially vertical. In some embodiments, the plane of the face of the backboard 140 may be orthogonal relative to a plane of the lower surface 118. Alternatively or additionally, the angle between the plane of the face of the backboard 140 and the plane of the upper surface 116 may be greater than 90 degrees.

In some embodiments, the backboard 140 may be coupled to the distal end of the vertical supports 130. For example, the backboard 140 may be coupled to the distal end of the vertical supports 130 and may extend toward the base 110 while leaving a gap between the backboard 140 and the base 110. Alternatively or additionally, the backboard 140 may be coupled to the entire length of the vertical supports 130. For example, the backboard 140 may couple to the distal end of the vertical supports 130 and may extend toward the base 110 until the backboard 140 contacts, or nearly contacts, the base 110.

In some embodiments, the backboard 140 may be inflatable. Alternatively or additionally, the backboard 140 may include buoyant materials that may float in water. For example, the backboard 140 may include materials configured to retain air and/or provide buoyancy to the multiple game device 100, which materials may be analogous to the materials of the base 110. Alternatively or additionally, the materials of the backboard 140 may include a sheath which may be stitched to other elements of the backboard 140 and may include novelty designs and/or logos.

In some embodiments, the backboard 140 may be coupled to the vertical supports 130 such that there is a fluid communication of air between the backboard 140 and the vertical supports 130. For example, a cavity on the inside of the backboard 140 may be joined with a cavity inside the vertical supports 130 such that the movement of air between the backboard 140 and the vertical supports 130 may be unrestricted.

Alternatively or additionally, the backboard 140 may include a partition that may restrict air passing between the cavity of the backboard 140 and the cavity of the vertical supports 130. In instances in which air does not pass between the backboard 140 and the vertical supports 130, a valve may be disposed in the backboard 140 which may be used to facilitate inflation of the backboard 140. In one aspect, a valve may be disposed in the backboard 140 that may enable a hand and/or electric pump to be used for inflation of the backboard 140.

In some embodiments, the rectangular insert 142 may be positioned on an upper portion of the backboard 140 and may be smaller than the backboard 140. Alternatively or additionally, the rectangular insert 142 may be approximately equal in size to the backboard 140.

In some embodiments, the rectangular insert 142 may be positioned centrally between the vertical supports 130 and generally above a horizontal midline of the backboard 140.

In some embodiments, the rectangular insert 142 may include a material designed to absorb energy from an object impacting the rectangular insert 142. For example, the rectangular insert 142 may include a high-density foam board. Alternatively or additionally, the rectangular insert 142 may include foam boards that vary in density all while still designed to absorb energy from an incoming object. For example, the rectangular insert 142 may include a low-density foam board and/or a medium-density foam board. In some embodiments, the rectangular insert 142 may include a covering that may be a similar material as the backboard 140. For example, in instances in which the backboard 140 includes PVC, the rectangular insert 142 may include a PVC cover over the material forming the rectangular insert 142. Alternatively or additionally, the rectangular insert 142 may attach to the outer surface of the backboard 140 and may not include a cover disposed thereon.

In some embodiments, the rim 150 may attach to a lower portion of the backboard 140. In some embodiments, the rim 150 may be configured to be horizontally centered and below the rectangular insert 142. For example, the rim 150 may be horizontally centered between the lateral edges of the backboard 140 and may be vertically centered between the bottom of the backboard 140 and the bottom of the rectangular insert 142.

In some embodiments, the rim 150 may be inflatable. Alternatively or additionally, the rim 150 may include buoyant materials that may float in water. For example, the rim 150 may include materials configured to retain air and/or provide buoyancy to the multiple game device 100, which materials may be analogous to the materials of the base 110. Alternatively or additionally, the materials of the rim 150 may include a sheath which may be stitched to other elements of the rim 150 and may include novelty designs and/or logos.

In some embodiments, the rim 150 may be coupled to the backboard 140 such that there is a fluid communication of air between the rim 150 and the backboard 140. For example, a cavity on the inside of the rim 150 may be joined with a cavity inside the backboard 140 such that the movement of air between the rim 150 and the backboard 140 may be unrestricted. Alternatively or additionally, the rim 150 may include a partition that may restrict air passing between the cavity of the rim 150 and the cavity of the backboard 140. In instances in which air does not pass between the rim 150 and the backboard 140, a valve may be disposed in the rim 150 which may be used for inflation of the rim 150.

Alternatively or additionally, the rim 150 may include a ring of a light, buoyant material covered by a similar material that may be used to hold air as part of the multiple game device 100. For example, the rim 150 may include a ring of expanded polystyrene covered in PVC which may appear the same as an air-filled component but may be more rigid and resistant to deformation when contacted by an incoming object.

In some embodiments, the net 152 may be coupled to a bottom portion of the rim 150. In some embodiments, the net 152 may be formed of the same material as the rim 150 and may not be removeable. Alternatively or additionally, the net 152 may be removable and/or replaceable, such as if the net 152 becomes deformed and/or damaged. In some embodiments, the net 152 may include a fabric material, such as nylon, polyester, cotton, and/or other similar fabrics.

In some embodiments, small waterproof LEDs may be disposed throughout the multiple game device 100. For example, small waterproof LEDs may be positioned along the lateral edges of the base 110, around and/or in the receptacle 120, vertically along the vertical supports 130, around the edges of the backboard 140, around the rim 150, and/or in the net 152. In some embodiments, the small waterproof LEDs may be held in place by the sheath described in the individual elements of the multiple game device 100. Alternatively or additionally, the small waterproof LEDs may be stitched and/or affixed to the materials that constitute the base 110. In some embodiments, the small waterproof LEDs may enable the multiple game device 100 to be used in low-light settings.

Modifications, additions, or omissions may be made to the multiple game device 100 without departing from the scope of the present disclosure. For example, the size of the multiple game device 100 may be scaled to include a miniature size model, a full-size model, an oversized model, and/or various sizes in between. Modifications, additions, or omissions may also be made to the elements of the multiple game device 100 without departing from the scope of the present disclosure. For example, in some embodiments, the base 110 may be modified to support a first ball toss game and/or a ring toss game, as described below. Further, in some embodiments, the backboard 140 may be modified to support a second ball toss game and/or a darts game, as described below.

In some embodiments, the multiple game device 100 may be scaled to include a small, tabletop variant. Alternatively or additionally, the individual elements of the multiple game device 100 may be scaled to be a smaller size and may include a similar ratio of size between the different elements as described above. For example, the base 110, the receptacle 120, the vertical supports 130, the backboard 140, the rectangular insert 142, and the rim 150 may all be relatively smaller than the above described elements to adapt to the smaller variant of the multiple game device 100.

In some embodiments, the multiple game device 100 may be scaled to include a large, oversized variant. Alternatively or additionally, the individual elements of the multiple game device 100 may be scaled to be a larger size and may include a similar ratio of size between the different elements as described above. For example, the base 110, the receptacle 120, the vertical supports 130, the backboard 140, the rectangular insert 142, and the rim 150 may all be relatively larger than the above described elements to adapt to the larger variant of the multiple game device 100.

Alternatively or additionally, the multiple game device 100 may be scaled to be any size between the above described tabletop multiple game device 100 and the oversized multiple game device 100.

In some embodiments, more than one receptacle may be disposed in the base 110. In some embodiments, the multiple receptacles may be uniformly distributed across the base 110. Alternatively or additionally, the multiple receptacles may be randomly distributed across the base 110. Alternatively or additionally, the multiple receptacles may be distributed in a pattern-like manner. For example, a greater number of the multiple receptacles may be disposed near the first end 112 of the base 110 and a fewer number of the multiple receptacles may be disposed near the second end 114 of the base 110. In some embodiments, the multiple receptacles may include different sized diameters. For example, some of the multiple receptacles may include a smaller diameter than other receptacles of the multiple receptacles.

In some embodiments, one or more posts may be attached to the upper surface 116 of the base 110. The posts may be in addition to or in the alternative to the receptacle 120. In some embodiments, the posts may be distributed in a pattern-like manner. For example, a greater number of the posts may be disposed near the first end 112 of the base 110 and a fewer number of the posts may be disposed near the second end 114 of the base 110. Alternatively or additionally, the posts may be randomly distributed across the base 110.

In some embodiments, multiple receptacles may be disposed in the backboard 140. In some embodiments, the multiple receptacles may be uniformly distributed across the backboard 140. Alternatively or additionally, the multiple receptacles may be randomly distributed across the backboard 140. Alternatively or additionally, the multiple receptacles may be distributed in a pattern-like manner. For example, a greater number of the multiple receptacles may be disposed near the bottom of the backboard 140 and a fewer number of the multiple receptacles may be disposed near the top of the backboard 140. In some embodiments, the multiple receptacles may be differently sized.

In some embodiments, the backboard 140 may include a circular portion of hook and loop disposed centrally on the face thereof. In some embodiments, the circular hook and loop may be divided into concentric rings. For example, varying rings of hook and loop may include a different color than an adjacent ring of hook and loop such that the concentric circles may be easily differentiated. In some embodiments, the hook and loop concentric circles may be configured to receive and retain a corresponding hook and loop object, such as a dart with a hook and loop tip.

Figure 2:
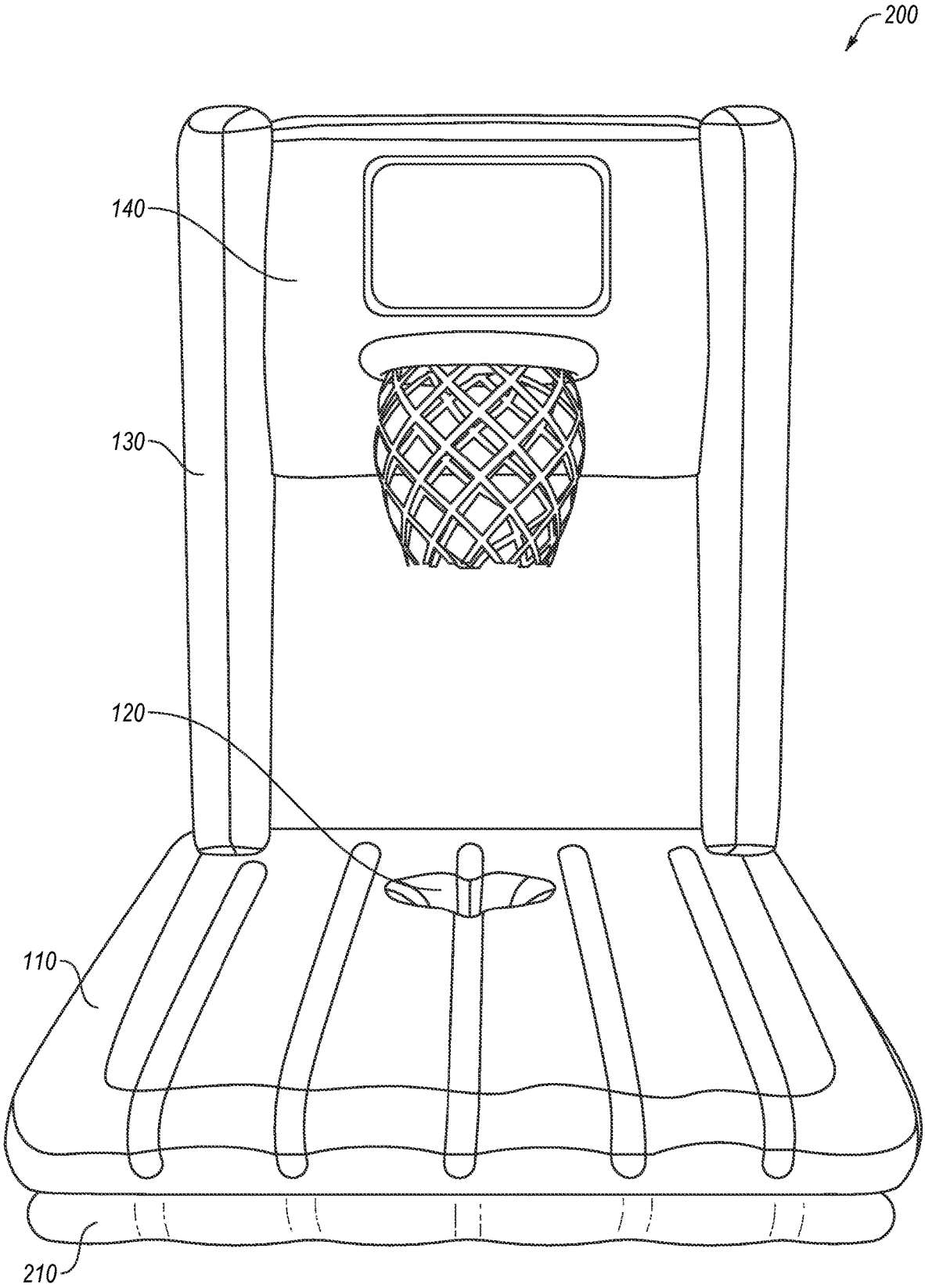
FIG. 2 is a front, perspective view of an alternative embodiment of a device configured for use for multiple different games.

FIG. 2 is a front, perspective view of an example embodiment of a multiple game device 200, in accordance with at least one embodiment described in the present disclosure. The multiple game device 200 may be analogous to the multiple game device 100 and may include some or all of the elements of the multiple game device 100 where like numerals refer to like features previously described. The multiple game device 200 may include a bladder 210.

In some embodiments, the bladder 210 may be disposed on or near the first end 112 of the base 110 and may be used to counterweight elements of the multiple game device 200, which may provide more stability to the multiple game device 200. Alternatively or additionally, the bladder 210 may be disposed between the first end 112 and the second end 114. Alternatively or additionally, more than one bladder 210 may be disposed on the multiple game device 200 and may be located at or near the first end 112, at or near the second end 114, between the first end 112 and the second end 114, and/or various combinations thereof.

In some embodiments, the bladder 210 may attach to the lower surface 118 of the base 110 at or near the first end 112 and may be substantially the same width as the base 110. For example, the bladder 210 may be approximately flush with the first end 112 on the lower surface 118 and may extend toward the second end 114. Alternatively or additionally, the bladder 210 may be configured to attach to the first end 112 of the base 110, between the upper surface 116 and the lower surface 118. For example, the bladder 210 may be approximately flush with the lower surface 118 and may extend toward the upper surface 116 and extend from the left edge of the base 110 to the right edge of the base 110. In some embodiments, the bladder 210 may include a substantially similar height as the base 110 on the first end 112, measured between the upper surface 116 and the lower surface 118. Alternatively or additionally, the bladder 210 may include a height that is greater than or less than the distance between the upper surface 116 and the lower surface 118. Alternatively or additionally, the width of the bladder 210 may be greater than or less than the width of the base 110 on the first end 112.

In some embodiments, the bladder 210 may be disposed on a lateral side of the base 110, such as the left side between the first end 112 and the second end 114. Alternatively or additionally, a bladder 210 may be disposed on the opposite lateral side of the base 110, such as the right side between the first end 112 and the second end 114. In these and other embodiments, the multiple bladders 210 may be attached to the lower surface 118. Alternatively or additionally, the multiple bladders 210 may attach to the base 110 between the upper surface 116 and the lower surface 118 and may be located between the first end 112 and the second end 114. In these and other embodiments, the multiple bladders 210 may be approximately flush with the lower surface 118 and may extend toward the upper surface 116.

In some embodiments, the bladder 210 may include the same or similar materials as the base 110. For example, the bladder 210 may include PVC, molded plastic, rubberized synthetic fabrics, blow-molded plastic, fiberglass, and/or other materials suited to retain weighted elements. In some embodiments, the bladder 210 may be formed of the same materials as the base 110 such that the bladder 210 is integrated with the base 110. Alternatively or additionally, the bladder 210 may be made of materials distinct from the base 110 and may be configured to be removed and/or reattached to the base 110.

In some embodiments, the bladder 210 may include a valve on the surface which may be configured to permit or restrict the flow of water between an interior of the bladder 210 and an exterior of the bladder 210. For example, in instances in which the bladder 210 is empty, the valve may be unstopped, and water may be pumped in, or flow in when the bladder 210 and the valve thereof are submerged in water. Alternatively or additionally, the bladder 210 may include an opening with a removable cap that may be larger than the valve. The opening with removable cap may permit faster filling and/or emptying of the bladder 210 and/or may permit a different and/or larger material to be used in the alterative to water. For example, water, sand, pebbles, and/or other small objects may be added to the bladder 210 through the opening with removable cap to counterbalance the multiple game device 200.

Modifications, additions, or omissions may be made to the multiple game device 200 without departing from the scope of the present disclosure. For example, the size of the multiple game device 200 may be scaled to include a miniature size model, a full-size model, an oversized model, and/or various sizes in between.

In some embodiments, the multiple game device 200 may be scaled to include a small, tabletop variant. Alternatively or additionally, the individual elements of the multiple game device 200 may be scaled to be a smaller size and may include a similar ratio of size between the different elements as described above. For example, the base 110, the bladders 210, and/or other elements may all be relatively smaller than the above described elements to adapt to the smaller variant of the multiple game device 200.

In some embodiments, the multiple game device 200 may be scaled to include a large, oversized variant. Alternatively or additionally, the individual elements of the multiple game device 200 may be scaled to be a larger size and may include a similar ratio of size between the different elements as described above. For example, the base 110, the bladders 210, and/or other elements may all be relatively larger than the above described elements to adapt to the larger variant of the multiple game device 200.

Figure 3:
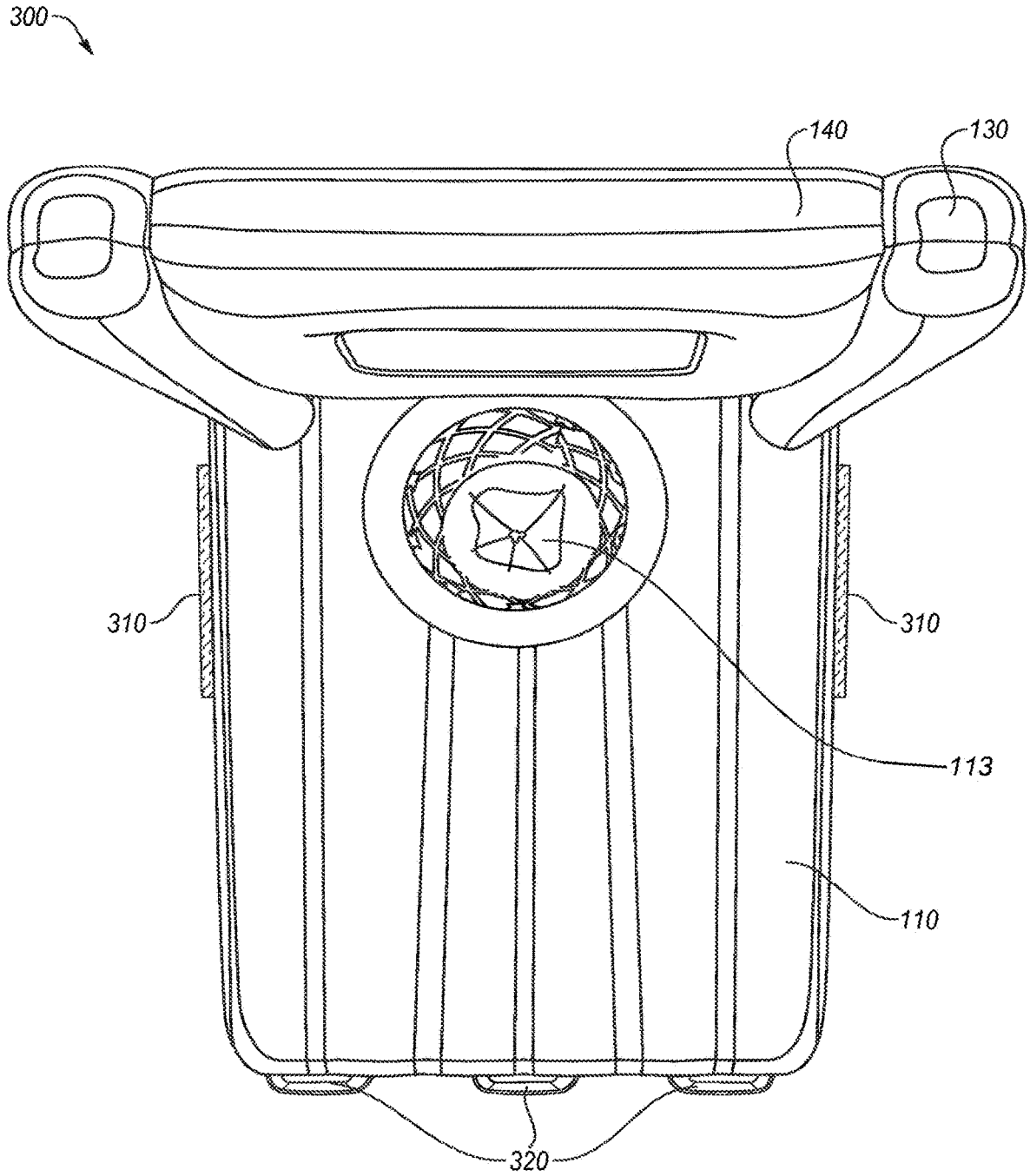
FIG. 3 is a top, perspective view of another alternative embodiment of a device configured for use for multiple different games.

FIG. 3 is a top, perspective view of an example embodiment of a multiple game device 300, in accordance with at least one embodiment described in the present disclosure. The multiple game device 300 may be analogous to the multiple game device 100, where like numerals refer to like features previously described. The multiple game device 300 may include weights 310 and pockets 320.

In some embodiments, the weights 310 may be configured to attach to the sides of the base 110 and may provide additional stability to the multiple game device 300. For example, the weights 310 may attach to the base 110 between the upper surface 116 and the lower surface 118 and may be located between the first end 112 and the second end 114.

In some embodiments, the weights 310 may be configured to attach to the base 110 using waterproof hook and loop. For example, a strip of waterproof hook and loop may be affixed to the base 110 and may be configured to receive the weights 310, which may include a complimentary portion of hook and loop, such that the weights 310 may attach to the base 110. Alternatively or additionally, the weights 310 may be tied, bonded, adhered, and/or otherwise attached to the base 110.

In some embodiments, the strip of waterproof hook and loop maybe approximately the same length as the weights 310. Alternatively or additionally, the strip of waterproof hook and loop may extend substantially from the first end 112 to the second end 114, such that the weights 310 may attach to the base 110 at any location between the first end 112 and the second end 114. Alternatively or additionally, the strip of waterproof hook and loop may be of any length including less than the length between the first end 112 and the second end 114, up to and including a length shorter than the length of the weights 310.

In some embodiments, the pockets 320 may be disposed on the first end 112 of the base 110. In some embodiments, the pockets 320 may be formed of the same materials as the base 110 such that the pockets 320 are integrated with the base 110. For example, in instances in which the base 110 is made of PVC, the base 110 may include extra PVC material on the first end 112 which may form the pockets 320. Alternatively or additionally, the pockets 320 may include different materials than the base 110 and may be attached to the base 110. For example, the pockets 320 may include hook and loop which may be complimentary to hook and loop attached to the first end 112 of the base 110. Alternatively or additionally, the pockets 320 may be bonded to the base 110.

In some embodiments, the pockets 320 may be configured to hold one or more objects that may be used to provide additional weight at the location of the pockets 320. In some embodiments, the pockets 320 may be sized and configured to retain various weighted objects. For example, the pockets 320 may be configured to retain an associated sandbag. Alternatively or additionally, the pockets 320 may retain sand, rocks, dirt, and/or other materials that may be located near the multiple game device 300 while in use.

In some embodiments, the weighted objects may be configured to be removable from the pockets 320. Alternatively or additionally, the pockets 320 may be sealed with the weighted objects stored therein such that the weighted objects may not be removable from the pockets 320.

In some embodiments, the pockets 320 may include buttons, snaps, zippers, and/or other fastening mechanisms disposed adjacent to the opening of the pockets 320 such that the weighted objects stored within the pockets 320 may be secured if it may become desirable to remove the weighted objects. For example, one or more sandbags may be added to the pockets 320 and a zipper may secure the sandbags within the pockets 320 during operation, after which, the zipper may be unzipped, and the sandbags removed from the pockets 320.

Modifications, additions, or omissions may be made to the multiple game device 300 without departing from the scope of the present disclosure. For example, the size of the multiple game device 300 may be scaled to include a miniature size model, a full-size model, an oversized model, and/or various sizes in between.

In some embodiments, the multiple game device 300 may be scaled to include a small, tabletop variant. Alternatively or additionally, the individual elements of the multiple game device 300 may be scaled to be a smaller size and may include a similar ratio of size between the different elements as described above. For example, the base 110, the weights 310, the pockets 320, and/or other elements may all be relatively smaller than the above described elements to adapt to the smaller variant of the multiple game device 300.

In some embodiments, the multiple game device 300 may be scaled to include a large, oversized variant. Alternatively or additionally, the individual elements of the multiple game device 300 may be scaled to be a larger size and may include a similar ratio of size between the different elements as described above. For example, the base 110, the weights 310, the pockets 320, and/or other elements may all be relatively larger than the above described elements to adapt to the larger variant of the multiple game device 300.

Figure 4:
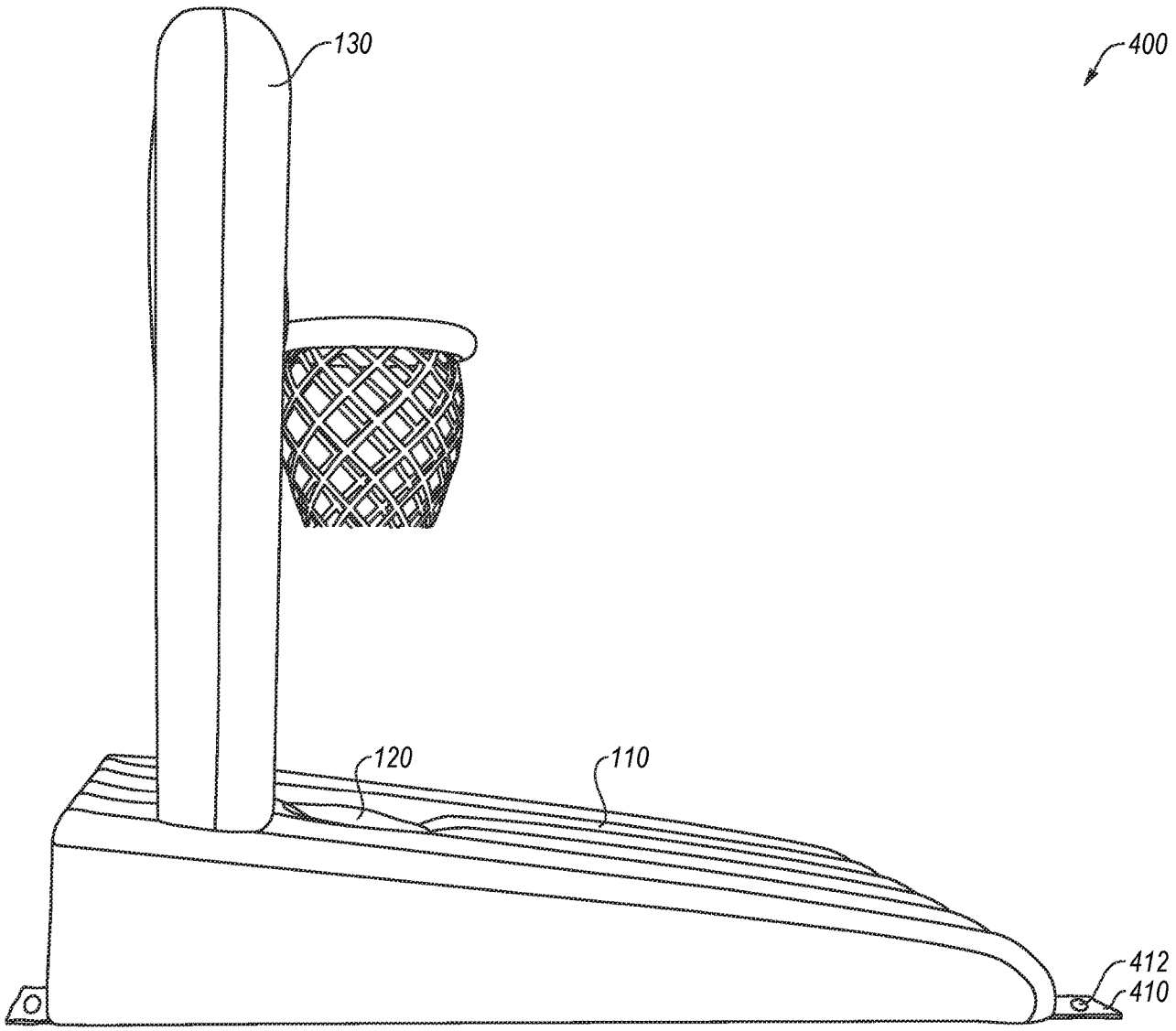
FIG. 4 is a side, perspective view of another alternative embodiment of a device configured for use for multiple different games.

FIG. 4 is a side, perspective view of an example embodiment of a multiple game device 400, in accordance with at least one embodiment described in the present disclosure. The multiple game device 400 may be analogous to the multiple game device 100 and may include some or all of the elements of the multiple game device 100, where like numerals refer to like features previously described. The multiple game device 400 may include flaps 410 which may include an engagement portion 412.

In some embodiments, the multiple game device 400 may include flaps 410 which may be located at or near the corners of the base 110. For example, in instances in which the base 110 is rectangular, the flaps 410 may be located in each corner of the base 110. Alternatively or additionally, the flaps 410 may be distributed around the base 110, such as equidistantly. Alternatively or additionally, the flaps 410 may be distributed about the base 110 such that more of the flaps 410 may be located opposite a heavier and/or a wind-catching element of the multiple game device 400. For example, the flaps 410 may be spaced closer together and/or more flaps 410 may be present on the first end 112 which is opposite the second end 114 which may include the taller and/or heavier elements of the multiple game device 400. In these and other embodiments, there may be more than or less than four flaps 410 as four flaps 410 as provided are only an example of possible locations.

In some embodiments, the flaps 410 may include an engagement portion 412 on an end thereof spaced from the base. In some embodiments, the engagement portion 412 may be similar to a grommet and may include metal, plastic, rubber, and/or other durable and corrosion resistant materials. In some embodiments, the engagement portion 412 may support a tie down which may contribute to anchoring and/or stabilizing the multiple game device 400. For example, in instances where the multiple game device 400 is on land (e.g., on a dirt, sand, grass, and/or similar surface), a tie down, such as a stake, may be used in conjunction with the engagement portion 412 of the flaps 410, which may help secure the multiple game device 400 to the ground. Alternatively or additionally, in instances where the multiple game device 400 is on water, one or more weights may be attached to the flaps 410 via the engagement portion 412 of the flaps 410, such as a weights with a hook end, which may contribute to stabilizing the multiple game device 400.

Modifications, additions, or omissions may be made to the multiple game device 400 without departing from the scope of the present disclosure. For example, the size of the multiple game device 400 may be scaled to include a miniature size model, a full-size model, an oversized model, and/or various sizes in between.

In some embodiments, the multiple game device 400 may be scaled to include a small, tabletop variant. Alternatively or additionally, the individual elements of the multiple game device 400 may be scaled to be a smaller size and may include a similar ratio of size between the different elements as described above. For example, the base 110, the flaps 410, the engagement portion 412, and/or other elements may all be relatively smaller than the above described elements to adapt to the smaller variant of the multiple game device 400.

In some embodiments, the multiple game device 400 may be scaled to include a large, oversized variant. Alternatively or additionally, the individual elements of the multiple game device 400 may be scaled to be a larger size and may include a similar ratio of size between the different elements as described above. For example, the base 110, the flaps 410, the engagement portion 412, and/or other elements may all be relatively larger than the above described elements to adapt to the larger variant of the multiple game device 400.

Figure 5:
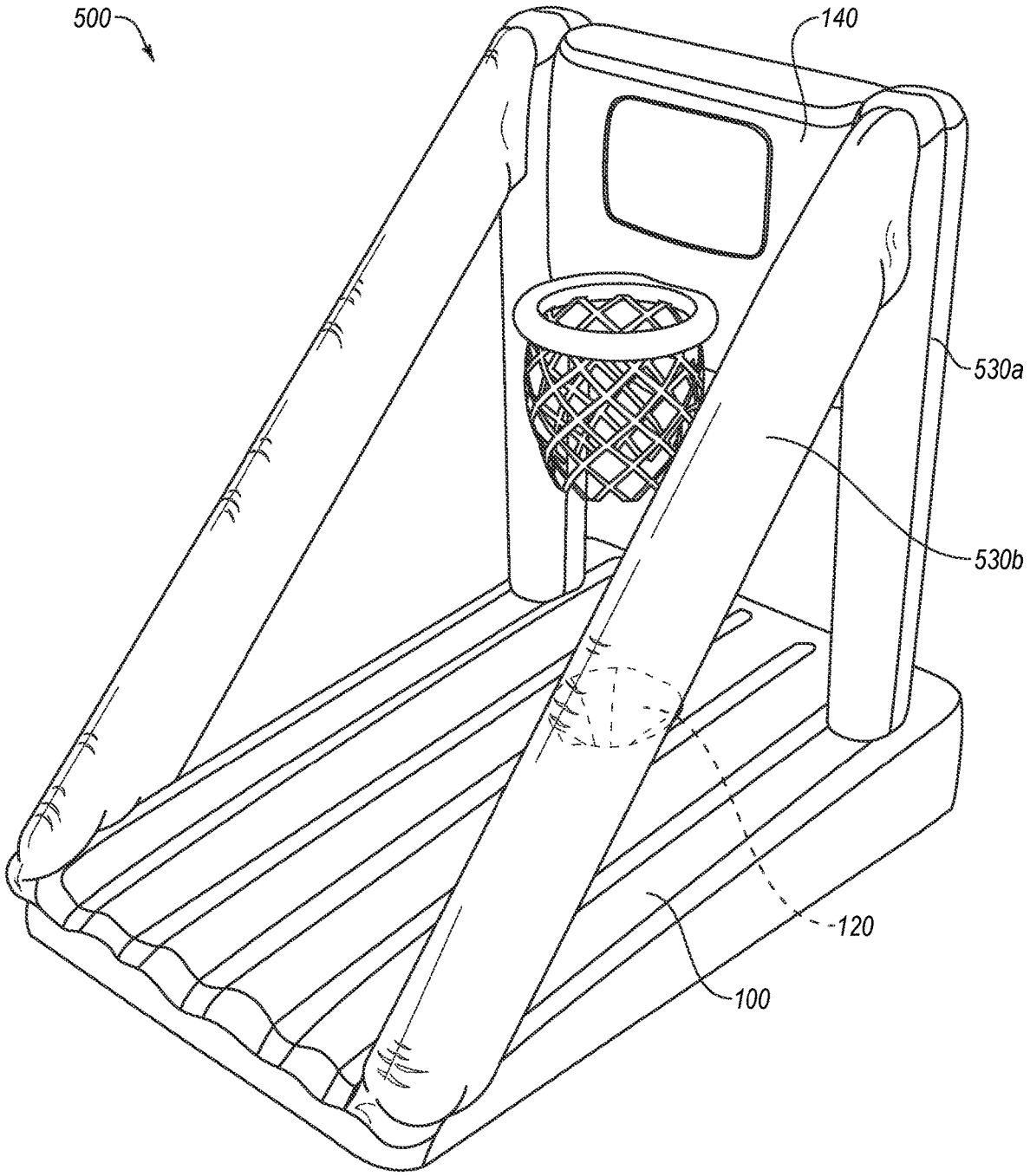
FIG. 5 is a perspective view of another alternative embodiment of a device configured for use for multiple different games.

FIG. 5 is a perspective view of an example embodiment of a multiple game device 500, in accordance with at least one embodiment described in the present disclosure. The multiple game device 500 may be analogous to the multiple game device 100, where like numerals refer to like features previously described. The multiple game device 500 may include vertical supports 530*a* and angled supports 530*b* (the vertical supports 530*a* and the angled supports 530*b* are hereinafter collectively referred to as support members 530).

In some embodiments, the support members 530 may be coupled to the base 110. Alternatively or additionally, the support members 530 may be formed from the same material as the base 110. In some embodiments, the support members 530 may extend from the base 110 from the upper surface 116. Alternatively or additionally, the support members 530 may extend from a lateral portion of the base 110, adjacent to the upper surface 116 and the lower surface 118.

In some embodiments, the vertical supports 530*a* may be positioned between the receptacle 120 and the second end 114. Alternatively or additionally, the vertical supports 530*a* may be positioned adjacent to the receptacle 120. Alternatively or additionally, the vertical supports 530*a* may be positioned at the second end 114.

In some embodiments, the vertical supports 530*a* may be substantially columnar from a coupling location on the base 110 to a distal end of the vertical supports 530*a*. Alternatively or additionally, the vertical supports 530*a* may widen at or near the coupling location to the base 110, which may add stability to the vertical supports 530*a*. For example, the vertical supports 530*a* may be columnar on the distal end and may gradually or quickly widen near the coupling location to the base 110.

In some embodiments, the angled supports 530*b* may be positioned at the first end 112. Alternatively or additionally, the angled supports 530*b* may be positioned between the receptacle 120 and the first end 112.

In some embodiments, the angled supports 530*b* may be substantially cylindrical from a coupling location on the base 110 to a distal end of the angled supports 530*b*. Alternatively or additionally, the angled supports 530*b* may widen at or near the coupling location to the base 110, which may add stability to the angled supports 530*b*. For example, the angled supports 530*b* may be cylindrical on the distal end and may gradually or quickly widen near the coupling location to the base 110.

In some embodiments, distal ends of the vertical supports 530*a* may be coupled to distal ends of the angled supports 530*b*. For example, the distal ends of the angled supports 530*b* may be bonded, adhered, and/or otherwise attached to the distal ends of the vertical supports 530*a* which may contribute to the vertical supports 530*a* remaining substantially vertical during use. Alternatively or additionally, the angled supports 530*b* may be configured to attach to the vertical supports 530*a* at a location other than the distal ends thereof. For example, the distal ends of the angled supports 530*b* may couple to the vertical supports 530*a* at any point between the distal ends of the vertical supports 530*a* and the coupling location on the base 110, such as at a midpoint between the distal ends of the vertical supports 530*a* and the coupling location to the base 110.

In some embodiments, the support members 530 may be inflatable. Alternatively or additionally, the support members 530 may include buoyant materials that may float in water. For example, the support members 530 may include materials configured to retain air and/or provide buoyancy to the multiple game device 500, which materials may be analogous to the materials of the base 110. Alternatively or additionally, the materials of the support members 530 may include a sheath which may be stitched to other elements of the support members 530 and may include novelty designs and/or logos.

In some embodiments, the support members 530 may be coupled to the base 110 such that there is a fluid communication of air between the support members 530 and the base 110. For example, a cavity on the inside of the support members 530 may be joined with a cavity inside the base 110 such that the movement of air between the support members 530 and the base 110 may be unrestricted.

Alternatively or additionally, the support members 530 may include a partition that may restrict air passing between the cavity of the support members 530 and the cavity of the base 110. In instances in which air does not pass between the support members 530 and the base 110, a valve may be disposed in one or more members of the support members 530 which may be used for inflation of the support members 530. Alternatively or additionally, a valve may be disposed in one or more members of the support members 530 that may enable a use of hand and/or electric pump to inflate the support members 530.

Modifications, additions, or omissions may be made to the multiple game device 500 without departing from the scope of the present disclosure. For example, the size of the multiple game device 500 may be scaled to include a miniature size model, a full-size model, an oversized model, and/or various sizes in between.

In some embodiments, the multiple game device 500 may be scaled to include a small, tabletop variant. Alternatively or additionally, the individual elements of the multiple game device 500 may be scaled to be a smaller size and may include a similar ratio of size between the different elements as described above. For example, the base 110, the support members 530, and/or other elements may all be relatively smaller than the above described elements to adapt to the smaller variant of the multiple game device 500.

In some embodiments, the multiple game device 500 may be scaled to include a large, oversized variant. Alternatively or additionally, the individual elements of the multiple game device 500 may be scaled to be a larger size and may include a similar ratio of size between the different elements as described above. For example, the base 110, the support members 530, and/or other elements may all be relatively larger than the above described elements to adapt to the larger variant of the multiple game device 500.

Figure 6:
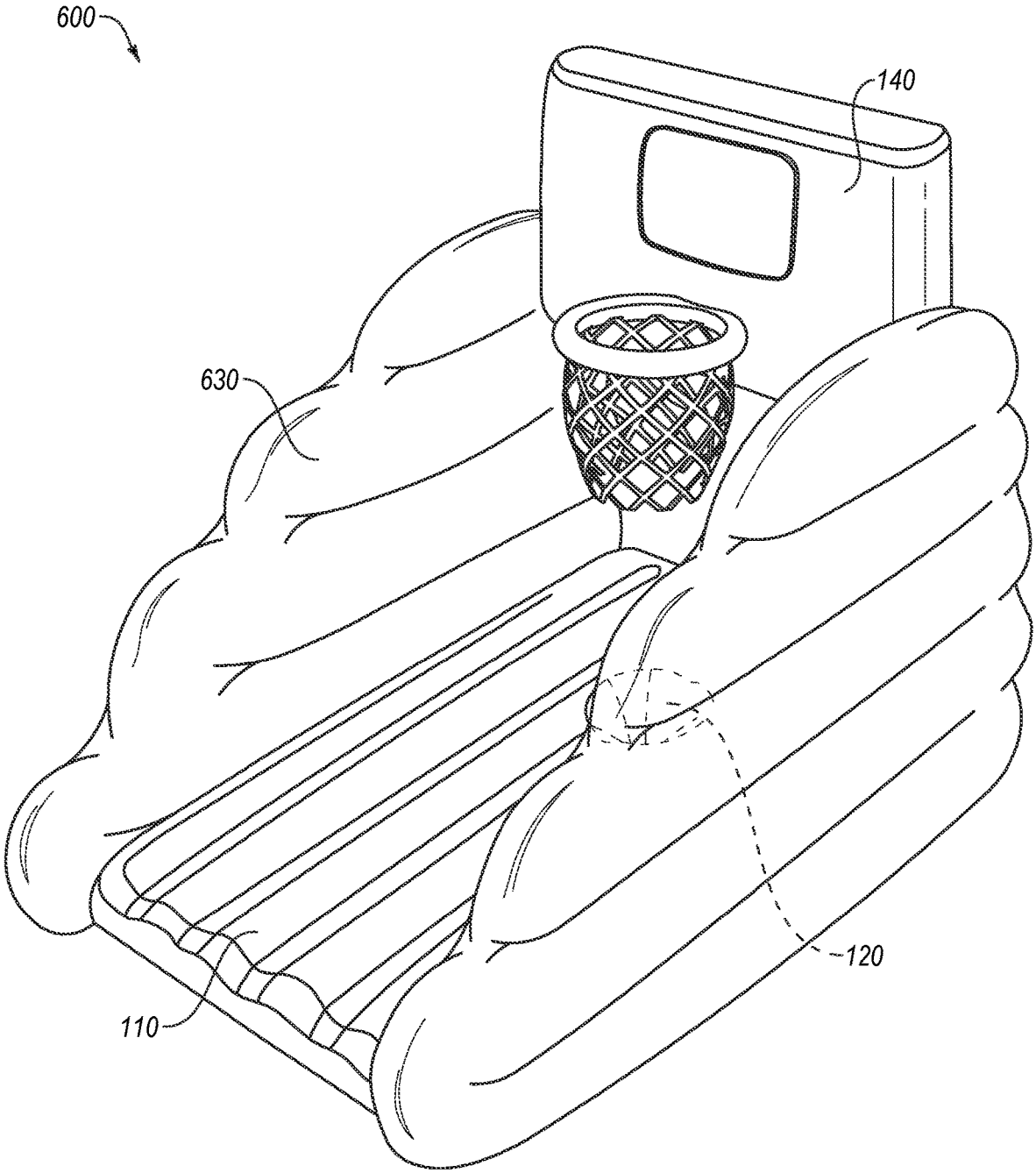
FIG. 6 is a perspective view of another alternative embodiment of a device configured for use for multiple different games.

FIG. 6 is a perspective view of an example embodiment of a multiple game device 600, in accordance with at least one embodiment described in the present disclosure. The multiple game device 600 may be analogous to the multiple game device 100, where like numerals refer to like features previously described. The multiple game device 600 may include vertical planar members 630.

In some embodiments, the vertical planar members 630 may be coupled to opposite sides of the base 110. For example, the vertical planar members 630 may form side walls to the base 110, which may extend from the first end 112 to the second end 114 and up to the backboard 140. Alternatively or additionally, the vertical planar members 630 may be formed from the same material as the base 110. In some embodiments, the vertical planar members 630 may contribute to the overall stability of the multiple game device 700 by adding additional lateral weight and/or redistributing some of the weight of the multiple game device 600 from the second end 114 toward the first end 112.

In some embodiments, a height of the vertical planar members 630 may be approximately the same as the width of the base 110 on the first end 112 and may vertically rise in a linear manner as the vertical planar members 630 near the second end 114. Alternatively or additionally, the vertical planar members 630 may vertically rise in a logarithmic manner, in a parabolic manner, in an exponential manner, in steps, and/or other manners of rising vertically. In some embodiments, a superior edge of the vertical planar members 630 may be located approximately at a vertical midline of the backboard 140. Alternatively or additionally, the vertical planar members 630 may extend vertically above a superior edge of the backboard, such that the vertical planar members 630 may be taller than the backboard 140 when the multiple game device 600 is on a flat surface.

In some embodiments, the vertical planar members 630 may horizontally extend from the first end 112 of the base 110 to the second end 114 of the base 110. Alternatively or additionally, the vertical planar members 630 may horizontally extend beyond the first end 112, extend beyond the second end 114, not fully reach the first end 112, not fully reach the second end 114, and/or any combinations thereof. For example, the vertical planar members 630 may attach to the sides of the base 110 and may horizontally extend beyond the first end 112 and beyond the second end 114.

In some embodiments, the vertical planar members 630 may extend from the base 110 from the upper surface 116. Alternatively or additionally, the vertical planar members 630 may extend from a lateral portion of the base 110, adjacent to the upper surface 116 and the lower surface 118.

Modifications, additions, or omissions may be made to the multiple game device 600 without departing from the scope of the present disclosure. For example, the size of the multiple game device 600 may be scaled to include a miniature size model, a full-size model, an oversized model, and/or various sizes in between.

In some embodiments, the multiple game device 600 may be scaled to include a small, tabletop variant. Alternatively or additionally, the individual elements of the multiple game device 600 may be scaled to be a smaller size and may include a similar ratio of size between the different elements as described above. For example, the base 110, the vertical planar members 630, and/or other elements may all be relatively smaller than the above described elements to adapt to the smaller variant of the multiple game device 600.

In some embodiments, the multiple game device 600 may be scaled to include a large, oversized variant. Alternatively or additionally, the individual elements of the multiple game device 600 may be scaled to be a larger size and may include a similar ratio of size between the different elements as described above. For example, the base 110, the vertical planar members 630, and/or other elements may all be relatively larger than the above described elements to adapt to the larger variant of the multiple game device 600.

Figure 7:
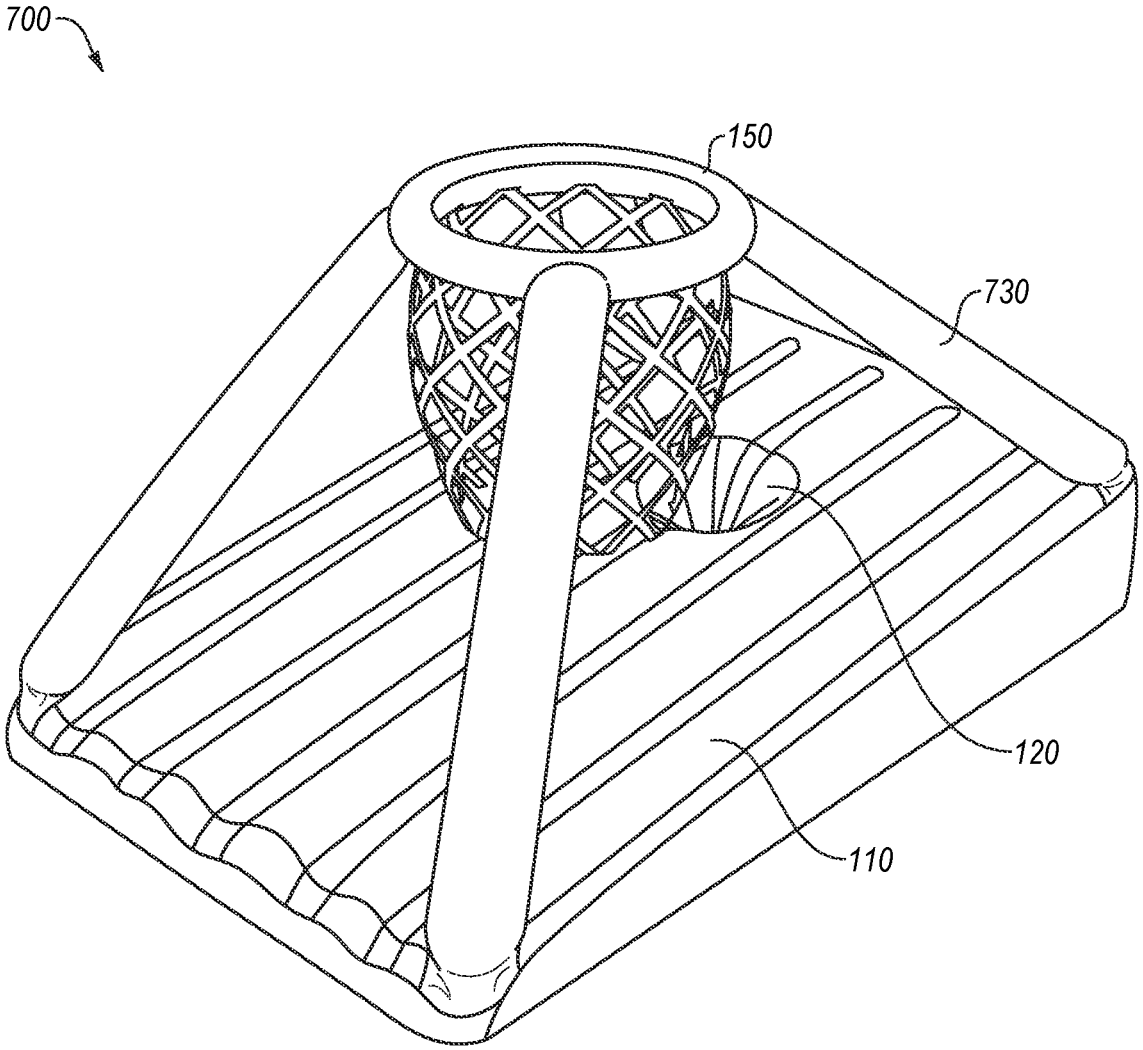
FIG. 7 is a perspective view of another alternative embodiment of a device configured for use for multiple different games.

FIG. 7 is a perspective view of an example embodiment of a multiple game device 700, in accordance with at least one embodiment described in the present disclosure. The multiple game device 700 may be analogous to the multiple game device 100, where like numerals refer to like features previously described. The multiple game device 700 may include support members 730.

In some embodiments, there may be four support members 730 in the multiple game device 700. For example, a rectangular base 110 may include four support members 730 with one of the support members 730 located in each corner of the base 110. Alternatively or additionally, there may be more of less than four support members 730 in the multiple game device 700. For example, a pentagonal base 110 may include five support members 730 with one of the support members 730 located in each corner of the base 110. In these and other embodiments, the number of support members 730 may not be identical as the number of sides of the base 110 nor may the support members 730 always be disposed on the corners of the base 110, as the foregoing were examples of different configurations of the number of support members 730 that may be included in the multiple game device 700. For example, a round base 110 may include three support members 730, or a hexagonal base 110 may include four support members 730.

In some embodiments, the support members 730 may be coupled to the base 110. Alternatively or additionally, the support members 730 may be formed from the same material as the base 110. In some embodiments, the support members 730 may extend from the base 110 from the upper surface 116. Alternatively or additionally, the support members 730 may extend from a lateral portion of the base 110, adjacent to the upper surface 116 and the lower surface 118.

In some embodiments, the support members 730 may be substantially cylindrical from a coupling location on the base 110 to a distal end of the support members 730. Alternatively or additionally, the support members 730 may widen at or near the coupling location to the base 110, which may add stability to the support members 730. For example, the support members 730 may be cylindrical on the distal end and may gradually or quickly widen near the coupling location to the base 110.

In some embodiments, distal ends of the support members 730 may be coupled to the rim 150. For example, the distal ends of the support members 730 may be bonded, adhered, and/or otherwise attached to the rim 150 which may support the rim 150 in a position above the upper surface 116 of the base 110.

In some embodiments, the support members 730 may extend from the base 110 to the rim 150 obliquely, where the rim may be located a central position to the support members 730 above the base 110. Alternatively or additionally, the support members 730 may extend substantially vertically from the base 110 to the rim 150. In some embodiments, the angle the support members 730 extend from the base 110 may be determined by the diameter of the rim 150, the coupling location of the support members 730 to the base 110, and/or combinations thereof. For example, in instances in which the rim 150 includes a diameter that is approximately the same width as the base 110, the support members 730 may extend substantially vertically from the base 110 to the rim 150.

In some embodiments, the length of the support members 730 may contribute to the angle of the support members 730. For example, the angle between vertical and longer length support members 730 may be less than the angle between vertical and shorter length support members 730.

In some embodiments, the support members 730 may be inflatable. Alternatively or additionally, the support members 730 may include buoyant materials that may float in water. For example, the support members 730 may include materials configured to retain air and/or provide buoyancy to the multiple game device 700, which materials may be analogous to the materials of the base 110. Alternatively or additionally, the materials of the support members 730 may include a sheath which may be stitched to other elements of the support members 730 and may include novelty designs and/or logos.

In some embodiments, the support members 730 may be coupled to the base 110 such that there is a fluid communication of air between the support members 730 and the base 110. For example, a cavity on the inside of the support members 730 may be joined with a cavity inside the base 110 such that the movement of air between the support members 730 and the base 110 may be unrestricted. Alternatively or additionally, the support members 730 may be coupled to the rim 150 such that there is a fluid communication of air between the support members 730 and the rim 150. For example, a cavity on the inside of the support members 730 may be joined with a cavity inside the rim 150 such that the movement of air between the support members 730 and the rim 150 may be unrestricted.

Alternatively or additionally, the support members 730 may include a partition that may restrict air passing between the cavity of the support members 730 and the cavity of the base 110 and/or between the cavity of the support members 730 and the cavity of the rim 150. In instances in which air does not pass between the support members 730 and the base 110 and/or the support members 730 and the rim 150, a valve may be disposed in one or more members of the support members 730 which may be used for inflation of the support members 730. Alternatively or additionally, a valve may be disposed in one or more members of the support members 730 that may enable a hand and/or electric pump to be used to inflate the support members 730.

Modifications, additions, or omissions may be made to the multiple game device 700 without departing from the scope of the present disclosure. For example, the size of the multiple game device 700 may be scaled to include a miniature size model, a full-size model, an oversized model, and/or various sizes in between.

In some embodiments, the multiple game device 700 may be scaled to include a small, tabletop variant. Alternatively or additionally, the individual elements of the multiple game device 700 may be scaled to be a smaller size and may include a similar ratio of size between the different elements as described above. For example, the base 110, the support members 730, and/or other elements may all be relatively smaller than the above described elements to adapt to the smaller variant of the multiple game device 700.

In some embodiments, the multiple game device 700 may be scaled to include a large, oversized variant. Alternatively or additionally, the individual elements of the multiple game device 700 may be scaled to be a larger size and may include a similar ratio of size between the different elements as described above. For example, the base 110, the support members 730, and/or other elements may all be relatively larger than the above described elements to adapt to the larger variant of the multiple game device 700.

Figure 8:
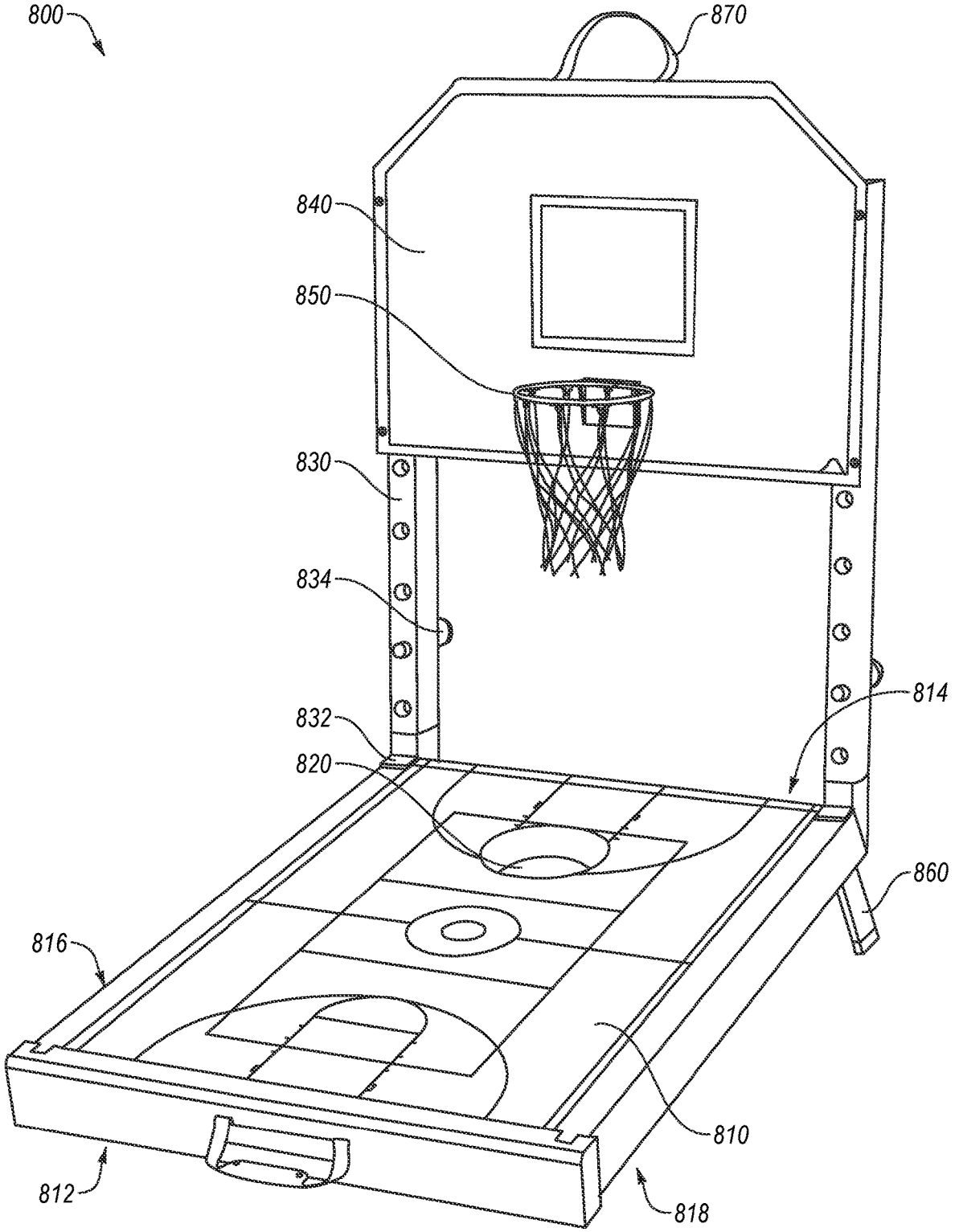
FIG. 8 is a perspective view of another alternative embodiment of a device configured for use for multiple different games.
Figure 9:
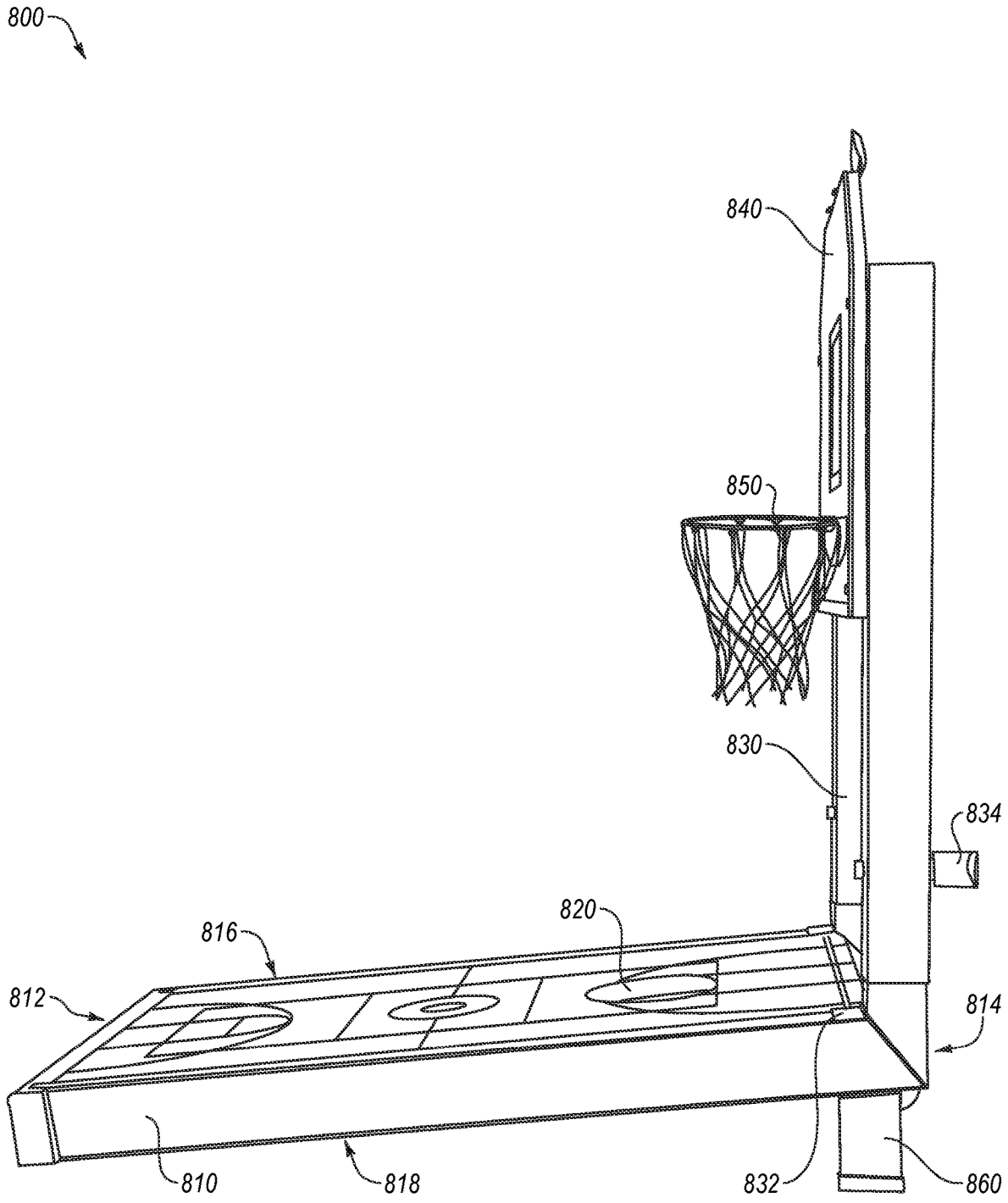
FIG. 9 is a side, perspective view of the device of FIG. 8.

FIG. 8 and FIG. 9 are a perspective view and a side view, respectively, of an example multiple game device 800, in accordance with at least one embodiment described in the present disclosure. The multiple game device 800 may include a base 810, a receptacle 820, vertical supports 830, a backboard 840, legs 860, and handles 870. The base 810 may include a first end 812, a second end 814, a first or upper surface 816, a second or lower surface 818, and hinges 832. The vertical supports 830 may include plungers 834. The backboard 840 may include a rim 850.

In some embodiments, the base 810 may be substantially rectangular in shape. Alternatively or additionally, the base 810 may include other shapes. For example, the base 810 may include other shapes such a square, a triangle, a trapezoid, an oval, a circle, and/or other similar geometric shapes. In some embodiments, the base 810 may include a first end 812 and a second end 814 where the first end 812 may be positioned opposite the second end 814 on the base 810.

In some embodiments, the upper surface 816 may extend from the first end 812 to the second end 814. In some embodiments, the upper surface 816 may extend from a left side of the base 810 to a right side of the base 810, such that the upper surface 816 may be substantially planar and may be used as a playing surface. For example, in instances in which the base 810 is rectangular, the upper surface 816 may be a rectangularly shaped plane. In some embodiments, the upper surface 816 may be inclined from the first end 812 to the second end 814. In some embodiments, the upper surface 816 may be positioned opposite the lower surface 818.

In some embodiments, the lower surface 818 may extend from the first end 812 to the second end 814 and may extend from a first side of the base 810 to a second, oppositely positioned side of the base 810. In some embodiments, the lower surface 818 may be substantially parallel to the upper surface 816. For example, the distance between the upper surface 816 and the lower surface 818 on the first end 812 may be substantially the same as the distance between the upper surface 816 and the lower surface 818 on the second end 814.

In some embodiments, a portion of the lower surface 818 may be configured to contact a surface on which the multiple game device 800 is positioned. For example, a portion of the lower surface 118 on the front end 812 may be in contact with a land surface, including grass, dirt, sand, and/or similar land environments in a land setting. Alternatively or additionally, all of the lower surface 818 may be configured to contact the surface on which the multiple game device 800 is positioned. For example, the multiple game device 800 may be placed on an inclined surface such that the lower surface 818 is substantially in contact with the inclined surface.

In some embodiments, accessories for the multiple game device 800 may be disposed and/or stored in the space between the upper surface 816 and the lower surface 818. For example, an audio device, a motion detection unit, and/or a power supply may be disposed between the upper surface 816 and the lower surface 818.

In some embodiments, the motion detection unit (not shown) may be associated with the receptacle 820 such that the motion detection unit may detect when an object passes through the receptacle 820. In some embodiments, the motion detection unit may include a mechanical device, such as a lever, that may move when contacted by an object, such as an object passing through the receptacle 820. Alternatively or additionally, the motion detection unit may include an electro-optical device (not shown), such as a laser or motion detector, that may register when an object passes through the receptacle 820.

In some embodiments, the power supply (not shown) may include one or more batteries that may be configured to provide power to the audio device, the electro-optical device, the scoreboard (as described below), and/or other electronic devices of the multiple game device 800. Alternatively or additionally, the power supply may include components that may be configured to transform energy from a power source to an energy level that may be useable by the multiple game device 800. For example, the power supply may transform energy from a 110V outlet and/or energy from one or more solar panels to an energy level that may be useable by the multiple game device 800.

In some embodiments, the audio device (not shown) may be configured to play a tone, music, and/or other audible sounds in conjunction with the multiple game device 800. For example, when an object enters the receptacle 820, the audio device may play a sound. Alternatively or additionally, the audio device may play a sound or music when the multiple game device 800 is powered on or powered off.

In some embodiments, the base 810 may include PVC, wood, cardboard, plastic, vinyl, metal, and/or other components that may be rigid, light, and/or able to form the structure thereof. For example, the base 810 may include high density PVC components that may be sturdy and/or light. In some embodiments, the materials of the base 810 may be paintable or otherwise display various graphics. For example, a basketball court may be drawn, painted, or otherwise displayed on the upper surface 816 of the base 810.

In some embodiments, the receptacle 820 may be formed in the upper surface 816 of the base 810 and may be positioned between the first end 812 and the second end 814. In some embodiments, the receptacle 820 may be located equidistantly between opposite sides of the base 810. In some embodiments, the receptacle 820 may be positioned nearer the second end 814.

In some embodiments, the receptacle 820 may include a circular opening. Alternatively or additionally, the receptacle 820 may include different shapes. For example, the receptacle 820 may include such shapes as square, oval, triangular, pentagonal, hexagonal, and other similar shapes.

In some embodiments, the receptacle 820 may extend through the base 810 from the upper surface 816 to the lower surface 818. For example, the shape of the receptacle 820 in the upper surface 816 may include a corresponding shape in the lower surface 818, and the receptacle 820 may include a channel between the upper surface 816 and the lower surface 818. Alternatively or additionally, the receptacle 820 may include a closed end that may be positioned between the upper surface 816 and the lower surface 818. For example, a partition may be positioned between the upper surface 816 and the lower surface 818 such that an object may not pass through the receptacle 820 from the upper surface 816 to the lower surface 818. In some embodiments, the closed end of the receptacle 820 may include the lower surface 818. For example, the lower surface 818 may include a continuous surface, such that there is no channel between the upper surface 816 and the lower surface 818.

In some embodiments, a panel (not shown) may be disposed in the space between the upper surface 816 and the lower surface 818. In some embodiments, the panel may be used to cover the receptacle 820, such that objects may not be able to enter the receptacle 120. For example, in instances in which a person wants to play basketball only, the panel may cover the receptacle 820 such that a basketball may not get stuck therein. Alternatively or additionally, a rear panel (not shown) may be disposed on the back of the backboard 840 such that the rear panel is opposite the orientation of the receptacle 820. In some embodiments, the rear panel may be used to cover a rear gap defined by the space between the vertical supports 830 and between the bottom of the backboard 840 and the upper surface 816. For example, in instances in which a person wants to play basketball only, the rear panel may cover the rear gap such that a basketball may not pass through the rear gap.

In some embodiments, the vertical supports 830 may be coupled to the base 810. For example, the vertical supports 830 may be coupled to the base using the hinges 832. In some embodiments, the hinges 832 may be configured to provide the vertical supports 830 rotation from a flat position to an upright position. In some embodiments, the hinges 832 may be lockable, such that when the vertical supports 830 are in an upright position, the hinges 832 may prevent the vertical supports 830 from closing to the flat position without additional input. For example, in instances in which the vertical supports 830 are in an upright position, a button may be depressed before the vertical supports 830 may be moved to the flat position.

In some embodiments, the vertical supports 830 may be substantially vertical when in the upright position. Alternatively or additionally, the vertical supports 830 may be substantially flat to the upper surface 812 of the base 810 in a flat position.

In some embodiments, the vertical supports 830 may include an inner portion and an outer portion. In some embodiments, the inner portion of the vertical supports 830 may be attached to the base 810, such as by the hinges 832. In these and other embodiments, the inner portion of the vertical supports 830 may be fixed translationally, such that the inner portion of the vertical supports 830 may not move up or down with respect to the base 810. In some embodiments, the outer portion of the vertical supports 830 may be sized and configured to enclose the inner portion of the vertical supports 830. In some embodiments, the outer portion of the vertical supports 830 may enable the vertical supports 830 to raise and lower relative to the base 810 by sliding up and down relative to the inner portion of the vertical supports 830.

In some embodiments, the vertical supports 830 may include one or more holes that may pass horizontally through the vertical supports 830, in the same direction as the first end 812 to the second end 814. For example, the holes may pass through both the inner portion and the outer portion of the vertical supports 830. In some embodiments, the plungers 834 may be configured to pass through the holes of the vertical supports 830 and may secure the vertical supports 830 in a vertical position. For example, the plungers 834 may be removed, the vertical supports 830 may be adjusted up or down relative to the base 810, and the plungers 834 may be replaced which may hold the vertical supports 830 at a desired location.

In some embodiments, the vertical supports 830 may be positioned at the second end 814 of the base 810, such as on the upper surface 812. Alternatively or additionally, the vertical supports 830 may be positioned beyond the second end 814 of the base 810, such as adjacent to the upper surface 812.

In some embodiments, the vertical supports 830 may include PVC, wood, cardboard, plastic, vinyl, metal, and/or other components that may be rigid, light, and/or able to form the support structure. For example, the vertical supports 830 may include aluminum components that may be sturdy and/or light.

In some embodiments, a netting (not shown) may be attached to a lateral portion of the vertical supports 830 and a lateral portion of the base 810 which may form a side wall to the multiple game device 800. For example, the lateral portions of the vertical supports 830 and the lateral portions of the base 810 may include hooks, snaps, hook and loop, and/or other fastening devices that may be complimentary to the netting that includes loops, snaps, hook and loop, and/or other complimentary fasteners. In some embodiments, the netting may extend from a distal, lateral portion of the vertical supports 830 down toward where the vertical supports 830 couple to the base 810 at the second end 814, and may extend along the lateral portion of the base 810 to the first end 812. In these and other embodiments, the netting may form sidewalls that may help funnel a basketball toward the first end 812 of the multiple game device 800.

In some embodiments, the backboard 840 may include a face that may be oriented toward the receptacle 830. In some embodiments, a plane defined by the face of the backboard 840 in the upright position may be oblique and/or greater than 90 degrees relative to the plane of the upper surface 816 of the base 810.

In some embodiments, the backboard 840 may be coupled to the vertical supports 830. For example, the backboard 840 may include bolts, screws, adhesives, and/or other fasteners to be coupled to the vertical supports 830. In some embodiments, the backboard 840 may be configured to be adjustable along the vertical supports 830. For example, the backboard 840 may be coupled to a distal end of the vertical supports 830 or may be coupled nearer the base 810 such that the bottom of the backboard 840 may be touching or nearly touching the upper surface 816.

In some embodiments, the backboard 840 may include PVC, wood, cardboard, plastic, vinyl, metal, and/or other components that may be rigid, light, and/or able to form the structure thereof. For example, the backboard 840 may include high density PVC components that may be sturdy and/or light. In some embodiments, the materials of the backboard 840 may be paintable or otherwise display various graphics. For example, a square, various logos, and/or decals may be drawn, painted, or otherwise displayed on the face of the backboard 840.

In some embodiments, the backboard 840 may include an electronic scoreboard (not shown). The electronic scoreboard may be configured to display the number of baskets or goals that have been detected. For example, in instances that the motion detection unit detects an object entering the receptacle 820 and/or entering the rim 850, the scoreboard may increment by one. Alternatively or additionally, the scoreboard may increment by a different amount based on the location of the detected object. For example, an object that enters the rim 850 may increment the value displayed on the scoreboard by two. Alternatively or additionally, the scoreboard may be manual operated such that a user may control the increment and/or decrement of the displayed values. In some embodiments, the scoreboard may be electrically coupled to the power supply.

In some embodiments, the rim 850 may attach to a lower portion of the backboard 840. In some embodiments, the rim 150 may be configured to be positioned horizontally centered between opposite sides of the backboard 840. In some embodiments, a net may attach to an inferior portion of the rim 850. The net may include polyester, cotton, nylon, chain link, and/or other similar net materials.

In some embodiments, the rim 850 may be coupled to the backboard 840 with a rim hinge, which may be similar to the hinges 832. In some embodiments, the rim hinge may be lockable, such that the rim hinge may be configured to hold the rim 850 substantially horizontal in an operable position and may allow the rim 850 to be substantially flat to the backboard 840 in a collapsed position. In some embodiments, the rim hinge may transition from the collapsed position to the operable position without disengaging the lock. Alternatively or additionally, the rim hinge may use additional input to transition from the operable position to the collapsed position. For example, in instances in which the rim 850 is in the operable position, a button may be depressed before the rim 850 may be moved to the collapsed position.

In some embodiments, the motion detection unit (not shown) may be associated with the rim 850 such that the motion detection unit may detect when an object passes through the rim 850, similar to a motion detection unit associated with the receptacle 820. In some embodiments, the motion detection unit may include a mechanical device, such as a lever, that may move when contacted by an object, such as an object passing through the rim 850. Alternatively or additionally, the motion detection unit may include an electro-optical device (not shown), such as a laser or motion detector, that may register when an object passes through the rim 850.

In some embodiments, the legs 860 may be coupled to the base 810 on the second end 814 and when extended, may raise the second end 814 of the base 810 relative to the first end 812. For example, extending the legs 860 may incline the upper surface 816 from the first end 812 to the second end 814. In some embodiments, the legs 860 may be rotatable such that the legs 860 may rotate into the base 810, such as between the upper surface 816 and the lower surface 818.

In some embodiments, the legs 860 may include a shaft (not shown) coupled between the legs 860. In some embodiments, the shaft may include one or more wheels (not shown) attached thereto. In instances in which the legs 860 are extended, the wheels may be configured to retract and not engage the surface the multiple game device 800 is located on. In instances in which the legs 860 are retracted, the wheels may be configured to extend and engage the surface, such that the multiple game device 800 may be configured to roll across the surface.

In some embodiments, the handles 870 may be located on a superior edge of the backboard 840. Alternatively or additionally, the handles 870 may be located on the first end 812 of the base 810. In some embodiments, the handles 870 on the backboard and the handles 870 on the first end 812 may be adjacent to each other when the backboard 840 and the vertical supports 830 are in a flat position. In some embodiments, the handles 870 on the backboard and the handles 870 on the first end 812 may be configured to attach to one another when the handles 870 are adjacent. For example, the handles 870 may include complimentary magnets and/or hook and loop such that when the handles are near each other, the handles 870 may attach to each other.

In some embodiments, the handles 870 may include fabrics such as nylon, cotton, and/or polyester, rubber, various plastics, and/or other pliable materials. In some embodiments, the handles 870 may be used in conjunction with the wheels to pull and roll the multiple game device 800.

Modifications, additions, or omissions may be made to the multiple game device 800 without departing from the scope of the present disclosure. For example, the size of the multiple game device 800 may be scaled to include a miniature size model, a full-size model, an oversized model, and/or various sizes in between.

In some embodiments, the multiple game device 800 may be scaled to include a small, tabletop variant. Alternatively or additionally, the individual elements of the multiple game device 800 may be scaled to be a smaller size and may include a similar ratio of size between the different elements as described above. For example, the base 810, the receptacle 820, the vertical supports 830, the backboard 840, the rim 850, the legs 860, and/or other elements may all be relatively smaller than the above described elements to adapt to the smaller variant of the multiple game device 800.

In some embodiments, the multiple game device 800 may be scaled to include a large, oversized variant. Alternatively or additionally, the individual elements of the multiple game device 800 may be scaled to be a larger size and may include a similar ratio of size between the different elements as described above. For example, the base 810, the receptacle 820, the vertical supports 830, the backboard 840, the rim 850, the legs 860, and/or other elements may all be relatively larger than the above described elements to adapt to the larger variant of the multiple game device 800.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, it is understood that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

Additionally, the use of the terms "first," "second," "third," etc., are not necessarily used herein to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

All examples and conditional language recited herein are intended for pedagogical objects to aid the reader in understanding the invention and the concepts contributed by the inventor to furthering the art, and are to be construed as being without limitation to such specifically recited examples and conditions. Although embodiments of the present disclosure have been described in detail, it should be understood that the various changes, substitutions, and alterations could be made hereto without departing from the spirit and scope of the present disclosure.

What is claimed is:

1. An apparatus, comprising:

a buoyant base including a first end, a second end positioned opposite of the first end, a first surface, and a second surface positioned opposite of the first surface;

one or more receptacles formed in the first surface of the buoyant base and positioned between the first end of the buoyant base and the second end of the buoyant base, the one or more receptacles having a first diameter sized for a first object associated with a first game, wherein the first game is cornhole;

a fluid-permeable partition positioned between the first surface and the second surface in the one or more receptacles, the fluid-permeable partition sized to prevent the first object, upon entering the one or more receptacles formed in the first surface, from passing through the permeable partition and exiting out of the second surface;

one or more buoyant vertical supports including a proximal end and a distal end, the one or more buoyant vertical supports extending from the buoyant base on a side of the one or more receptacles positioned opposite the first end of the buoyant base;

a buoyant rim coupled to a buoyant backboard, the buoyant rim having a second diameter sized for a second object associated with a second game, wherein the second game is basketball, wherein the buoyant rim includes a ring constructed of a first material, and wherein the ring is covered by a second material different from the first material, wherein an opening formed by the ring of the buoyant rim is aligned directly vertically above one of the one or more receptacles formed in the first surface;

the buoyant backboard coupled to the one or more buoyant vertical supports, the buoyant backboard including a face oriented toward the one or more receptacles, wherein;

the face of the buoyant backboard extends in a plane which extends relative to the first surface of the buoyant base at an angle greater than ninety degrees, where a first distance between the first surface and the buoyant rim is less than a second distance between the second surface and the buoyant rim; and a rectangular insert positioned above a horizontal midline of the buoyant backboard, the rectangular insert constructed of a third material configured to absorb energy from an object impacting the rectangular insert; and a bladder removably attached to the second surface between the first end and the second end, wherein the bladder includes one or more valves configured to permit or restrict a flow of water to an interior of the bladder to provide stability to the buoyant base.

2. The apparatus of claim 1, wherein at least one of the buoyant base, the one or more buoyant vertical supports, and the buoyant backboard is inflatable.

3. The apparatus of claim 1, wherein the one or more receptacles extends through the buoyant base from the first surface to the second surface.

4. The apparatus of claim 1, wherein the one or more receptacles includes a closed end positioned between the first surface and the second surface.

5. The apparatus of claim 1, wherein the buoyant rim and at least one receptacle of the one or more receptacles are coaxially aligned, and the buoyant rim is formed of an inflatable material.

6. The apparatus of claim 1, wherein the first end includes a first thickness between the first surface and the second surface, the second end includes a second thickness between the first surface and the second surface, and the second thickness is greater than the first thickness.

7. The apparatus of claim 1, wherein the rectangular insert is at least partially formed of a high-density foam material.

8. The apparatus of claim 1, wherein the first material is an expanded polystyrene material.

9. The apparatus of claim 1, wherein the first game is basketball, and the second game is cornhole.

10. The apparatus of claim 1, wherein the first object is basketball equipment, and the second object is cornhole equipment.

11. An apparatus, comprising:

a buoyant base including a first end, a second end positioned opposite of the first end, a first surface, and a second surface positioned opposite of the first surface;

one or more receptacles formed in the first surface of the buoyant base and positioned between the first end of the buoyant base and the second end of the buoyant base, the one or more receptacles having a first diameter sized for a first object associated with a first game, wherein the first game is cornhole;

a fluid-permeable partition positioned between the first surface and the second surface in the one or more receptacles, the fluid-permeable partition sized to prevent the first object, upon entering the one or more receptacles formed in the first surface, from passing through the permeable partition and exiting out of the second surface;

one or more buoyant vertical supports including a proximal end and a distal end, the one or more buoyant vertical supports extending from the buoyant base on a side of the one or more receptacles positioned opposite the first end of the buoyant base;

a buoyant rim coupled to a buoyant backboard, the buoyant rim having a second diameter sized for a second object associated with a second game, wherein the second game is basketball, wherein the buoyant rim includes a ring constructed of a first material, and wherein the ring is covered by a second material different from the first material, wherein an opening formed by the ring of the buoyant rim is aligned directly vertically above one of the one or more receptacles formed in the first surface;

the buoyant backboard coupled to the one or more buoyant vertical supports, the buoyant backboard including a face oriented toward the one or more receptacles, wherein:

the face of the buoyant backboard extends in a plane which extends relative to the first surface of the buoyant base at an angle greater than ninety degrees, where a first distance between the first surface and the buoyant rim is less than a second distance between the second surface and the buoyant rim; and a rectangular insert positioned above a horizontal midline of the buoyant backboard, the rectangular insert constructed of a third material configured to absorb energy from an object impacting the rectangular insert;

one or more weights coupled to the buoyant base between the first surface and the second surf ace and between the first end and the second end, a plurality of pockets coupled to the buoyant base at the first end, the plurality of pockets made of a material that is different from the buoyant base and configured to retain one or more objects.

12. An apparatus, comprising:

a buoyant base including a first end, a second end positioned opposite of the first end, a first surface, and a second surface positioned opposite of the first surface;

one or more receptacles formed in the first surface of the buoyant base and positioned between the first end of the buoyant base and the second end of the buoyant base, the one or more receptacles having a first diameter sized for a first object associated with a first game, wherein the first game is cornhole;

a fluid-permeable partition positioned between the first surface and the second surface in the one or more receptacles, the fluid-permeable partition sized to prevent the first object, upon entering the one or more receptacles formed in the first surface, from passing through the permeable partition and exiting out of the second surface;

one or more buoyant vertical supports including a proximal end and a distal end, the one or more buoyant vertical supports extending from the buoyant base on a side of the one or more receptacles positioned opposite the first end of the buoyant base;

a buoyant rim coupled to a buoyant backboard, the buoyant rim having a second diameter sized for a second object associated with a second game, wherein the second game is basketball, wherein the buoyant rim includes a ring constructed of a first material, and wherein the ring is covered by a second material different from the first material, wherein an opening formed by the ring of the buoyant rim is aligned directly vertically above one of the one or more receptacles formed in the first surface;

the buoyant backboard coupled to the one or more buoyant vertical supports, the buoyant backboard including a face oriented toward the one or more receptacles, wherein:

the face of the buoyant backboard extends in a plane which extends relative to the first surface of the buoyant base at an angle greater than ninety degrees, where a first distance between the first surface and the buoyant rim is less than a second distance between the second surface and the buoyant rim; and a rectangular insert positioned above a horizontal midline of the buoyant backboard, the rectangular insert constructed of a third material configured to absorb energy from an object impacting the rectangular insert;

one or more flaps coupled to the buoyant base, the one or more flaps each including an engagement portion on an end thereof spaced from the buoyant base; and one or more weights attached via the engagement portion to each of the one or more flaps.

* * * * *